US008650724B2

(12) United States Patent
King et al.

(10) Patent No.: US 8,650,724 B2
(45) Date of Patent: Feb. 18, 2014

(54) ZIPPERS FOR BAGS AND LUGGAGE

(75) Inventors: William L. King, Swansea, MA (US); Robert Thomas Zielinski, Barrington, RI (US)

(73) Assignee: Samsonite IP Holdings S.a.r.l., Luxembourg (LU)

( * ) Notice: Subject to any disclaimer, the term of this patent is extended or adjusted under 35 U.S.C. 154(b) by 156 days.

(21) Appl. No.: 13/193,351

(22) Filed: Jul. 28, 2011

(65) Prior Publication Data

US 2012/0023714 A1 Feb. 2, 2012

Related U.S. Application Data

(60) Provisional application No. 61/369,043, filed on Jul. 29, 2010, provisional application No. 61/444,017, filed on Feb. 17, 2011.

(51) Int. Cl.
*A44B 19/30* (2006.01)
*E05B 65/52* (2006.01)

(52) U.S. Cl.
USPC ..... 24/415; 4/385; 4/386; 4/436; 4/430; 4/387; 190/120; 70/68; 24/418

(58) Field of Classification Search
USPC ..... 24/386, 415, 382, 436, 430, 385, 387, 24/418; 19/120; 70/68; 190/120
See application file for complete search history.

(56) References Cited

U.S. PATENT DOCUMENTS

| | | | | |
|---|---|---|---|---|
| 3,049,780 | A * | 8/1962 | Llorens | 24/416 |
| 4,930,323 | A | 6/1990 | Terada et al. | |
| 4,951,485 | A | 8/1990 | Wake | |
| 5,031,944 | A * | 7/1991 | Keyaki | 292/307 R |
| 6,062,051 | A * | 5/2000 | Nam et al. | 70/68 |
| 7,516,523 | B2 * | 4/2009 | Okot | 24/385 |
| 7,979,964 | B2 * | 7/2011 | Jans | 24/386 |
| 2002/0050030 | A1 | 5/2002 | Takasawa | |
| 2005/0035605 | A1 | 2/2005 | Vanderwater-Piercy | |
| 2005/0109072 | A1 | 5/2005 | Ling et al. | |
| 2006/0000066 | A1 * | 1/2006 | Lin | 24/415 |

FOREIGN PATENT DOCUMENTS

| | | |
|---|---|---|
| CN | 01242559.1 | 4/2002 |
| CN | 201025933 | 2/2008 |
| CN | 201025934 | 2/2008 |
| CN | 300755508 | 3/2008 |
| CN | 300757929 | 3/2008 |
| DE | 29916218 | 3/2000 |
| WO | 2007111585 | 10/2007 |

* cited by examiner

*Primary Examiner* — Robert J Sandy
*Assistant Examiner* — Michael Lee
(74) *Attorney, Agent, or Firm* — Dorsey & Whitney LLP

(57) ABSTRACT

A zipper for luggage or a travel bag may include a slider and a releasable security device to provide access to the bag by authorized persons. The releasable security device may be configured to receive a portion of a locking apparatus, such as a padlock. A portion of the releasable security device may be received within the slider.

27 Claims, 21 Drawing Sheets

ZIPPERS FOR BAGS AND LUGGAGE

CROSS REFERENCES TO RELATED APPLICATIONS

This application claims benefit under 35 U.S.C. §119(e) to U.S. provisional application No. 61/369,043, entitled "Zippers for Bags and Luggage" filed on Jul. 29, 2010, and No. 61/444,017, entitled "Zippers for Bags and Luggage" filed on Feb. 17, 2011, both of which are hereby incorporated herein by reference in their entireties.

TECHNOLOGICAL FIELD

Described herein are luggage or bags and more particularly, zippers for luggage or bags that include one or more sliders with detachable security devices.

BACKGROUND

While traveling, many travelers attempt to lock or otherwise secure their luggage from unauthorized access to the items stored in the luggage. For example, it is common for airline passengers to secure their luggage to prevent someone from accessing items stored in the luggage while the luggage is out of the passenger's control. Typically, luggage is secured by affixing a locking mechanism to one or more access points of the luggage. For example (and as illustrated in FIG. 1), many travel bags 100 include a zipper 102 disposed around a compartment of the bag such that the compartment may be opened or sealed by zipping or unzipping the compartment. To secure the compartment, a traveler may affix a lock or other locking apparatus to one or more pull tabs of the zipper assembly to prevent access to the secured compartment. The lock may have an associated key that is kept by the passenger or a combination known only to the passenger such that access to the bag by someone other than the passenger is prevented.

However, recent additional security measures instituted by governmental agencies for traveling passengers may make securing a travel bag problematic. In many instances, federal or local agents may require access to the luggage of passengers to inspect the contents of the bag for security reasons. However, locked luggage may prevent such access by these authorized agents. Also, the passenger may no longer be near the luggage when the bag is checked to provide the needed key or combination for access into the bag. In these instances, the lock affixed to the luggage may need to be destroyed so that the security agents can access the luggage. Thus, often times, a traveler must choose between traveling with unsecured baggage or running the risk of having the lock of a secured bag destroyed during a security check.

One method developed to allow access to locked luggage by authorized agents is to sell approved locks that authorized agents may unlock. For example, a skeleton key for a particular brand of a lock may be developed and provided to the security agents so that they may unlock any bag secured for that particular brand of lock. Similarly, all locks of a particular manufacturer may have a master combination known by the security agents to unlock and access the bag. However, such locks may be costly and/or difficult to find for some passengers. Additionally, such locks may be lost or damaged when not in use.

SUMMARY

One embodiment of a zipper system for a bag may include a zipper track disposed around at least a portion of a compartment of the bag and a zipper including a slider, the slider operatively associated with the zipper track. The slider may include a slider base, a security device releasably joined to the slider base and configured to define at least one aperture to receive at least a portion of a locking apparatus, and a securing member movably joined to the slider base. The selective movement of the securing member relative to the slider base secures may releases the releasable security device to and from the slider base.

Another embodiment of a zipper system for a bag may include a zipper track disposed around at least a portion of a compartment of the bag and a zipper slider operatively associated with the zipper track. The zipper slider may include a modular slider base, a modular slider upper portion, a security device releasably joined to the modular slider upper portion and configured to define at least one aperture to receive at least a portion of a locking apparatus, and a securing member movably joined to the modular slider upper portion. The selective movement of the securing member relative to the modular slider upper portion secures and releases the releasable security device to and from the modular slider upper portion.

An embodiment of a method for constructing a zipper may include positioning a security device in a modular slider upper portion, releasably joining the security device to the modular slider upper portion via a securing member, and joining a modular slider base to the modular slider upper portion with a portion of a zipper pull tab disposed in an opening defined by the modular slider base and the modular slider upper portion.

Another embodiment of a method for constructing a zipper may include positioning a securing member in a slider base, disposing a pin through the securing member and joining the pin to the slider base, and releasably joining a security device to the slider base via the securing member.

Another embodiment of a zipper may include a first slider, a releasable security device selectively secured to the first slider and configured to receive at least a portion of a locking apparatus, and at least a portion of the releasable security device is received within the first slider when secured to the first slider.

Another embodiment of a zipper may include a first slider, a pull tab operatively associated with the first slider, means for selectively securing a releasable security device to the first slider. The releasable security device may include means for receiving a locking apparatus.

Another embodiment of a method for selectively releasing a first zipper slider from a second zipper slider may include releasing a releasable security device from a first zipper slider when the first zipper slider and a second zipper slider are joined together with a lock apparatus joined to the releasable security device and the second zipper slider, and moving the first and second zipper sliders relative to each other to open a zipper track associated with the first and second zipper sliders.

DETAILED DESCRIPTION

Described herein are zippers for a piece of luggage or other type of travel bag that include sliders that may be joined by a security apparatus to limit access to compartments closed by the zippers. At least one of the sliders may include a releasable security device that allows for the sliders to be selectively disconnected while remaining joined to the security apparatus to provide access to the compartment associated with the sliders by authorized persons. In one implementation, the security apparatus may be joined to pull tabs of the sliders to secure the sliders together. In such an implementation, the releasable security device may be joined to one of the pull tabs of one of the sliders. The releasable security device and the pull tab may then be selectively released from the corresponding slider base such that the zipper may be unzipped to provide access to the compartment while the pull tabs of each slider remains joined by the security apparatus. In one example, the pull tab and the releasable security device may be released from the corresponding slider base by rotating a securing member (such as a cam) that joins the releasable security device to its corresponding slider base such that the securing member ceases to be engaged with the slider base. In general, several methods may be utilized to engage and disengage the releasable portion and pull tab from the slider base of the slider to allow access to a secured travel bag by authorized personal.

In another embodiment, a slider of the zipper may include a releasable security device that may be joined to the slider base of a slider and secured thereto through a securing member. In addition, the releasable security device may be affixed to a portion of the travel bag such that translation of the slider along the zipper track and access to a compartment of the bag is prevented. To open the compartment of the travel bag, the securing member may be rotated into an open or unlocked position such that the releasable security device may detach from the slider base. This allows the slider of the zipper to be translated along the zipper track while the releasable security device remains secured to another slider or other securing device integrated into the travel bag. In this manner, the travel bag may remain secured until the releasable security device is detached from the slider. Once the releasable security device is detached from the slider, the zipper may be unzipped to allow a compartment of the bag to be opened during a security check of the bag. As described in more detail below, the releasable security device may take several forms and constructions to provide many levels of security for the travel bag.

Figure 1:
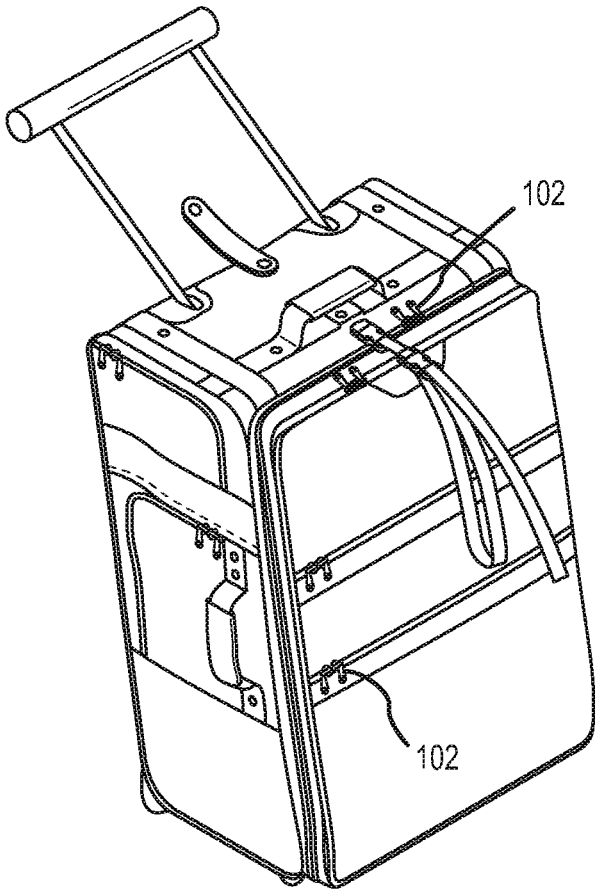
FIG. 1 is a diagram illustrating a typical travel bag, including a zipper disposed around a compartment of the bag for opening and closing the compartment.

As mentioned above and illustrated in FIG. 1, many travel bags 100 include a zipper 102 disposed around a compartment of the bag such that the compartment may be opened or sealed by utilizing the zipper. Often, such bags include two sliders on a single zipper track for ease of use. Each slider may include a slider base that connects or disconnects the teeth of the zipper (depending on the direction the slider is pulled) and a pull tab to aid the sliding of the slider base along the zipper track. For example, two sliders may be disposed along a single zipper track that at least partially encompasses a compartment of a travel bag. Manipulation of either slider along the zipper track engages or disengages the teeth of the zipper to allow access to, or sealing of, the compartment.

Figure 2A:
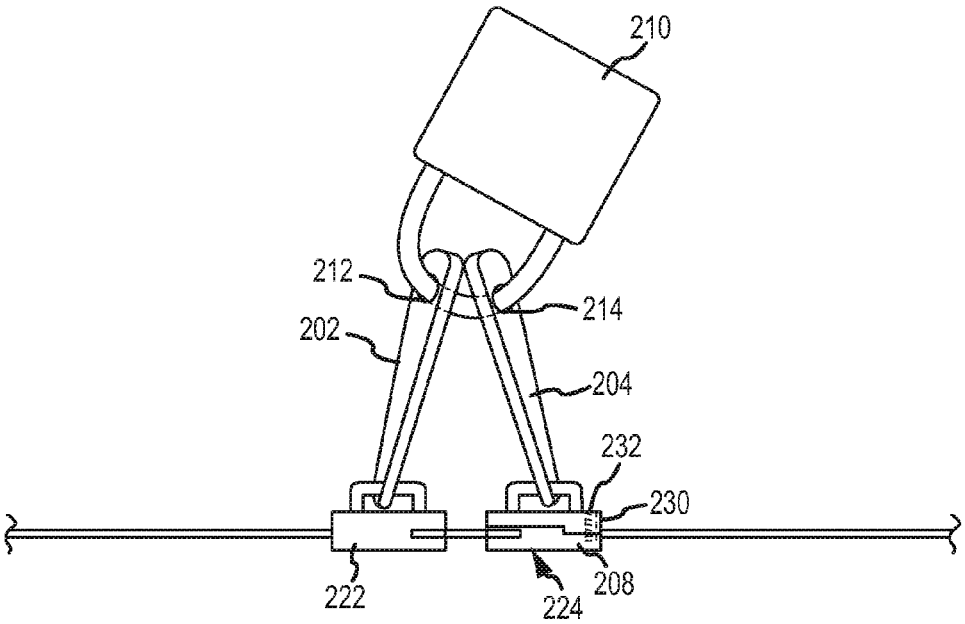
FIG. 2A is a schematic diagram illustrating a first zipper for a luggage compartment showing a security apparatus that joins two sliders of the zipper to limit access to the compartment closed by the zipper.

With reference to FIG. 2A, a bag may be secured by sliding the two sliders together. For example, to secure the compartment from access by an unauthorized person, a traveler may join the pull tabs 202, 204 associated with two sliders 222, 224 together using a security apparatus, such as a lock 210. To join the pull tabs 202, 204, a portion of the lock 210 may be passed through apertures 212, 214 defined by each pull tab 202, 204. When the joined pull tabs 202, 204 are pulled in either direction, the corresponding slider 222, 224 is also pulled in the same direction, such that the zipper teeth remain engaged and prevent access to the secured compartment of the bag.

Figure 2B:
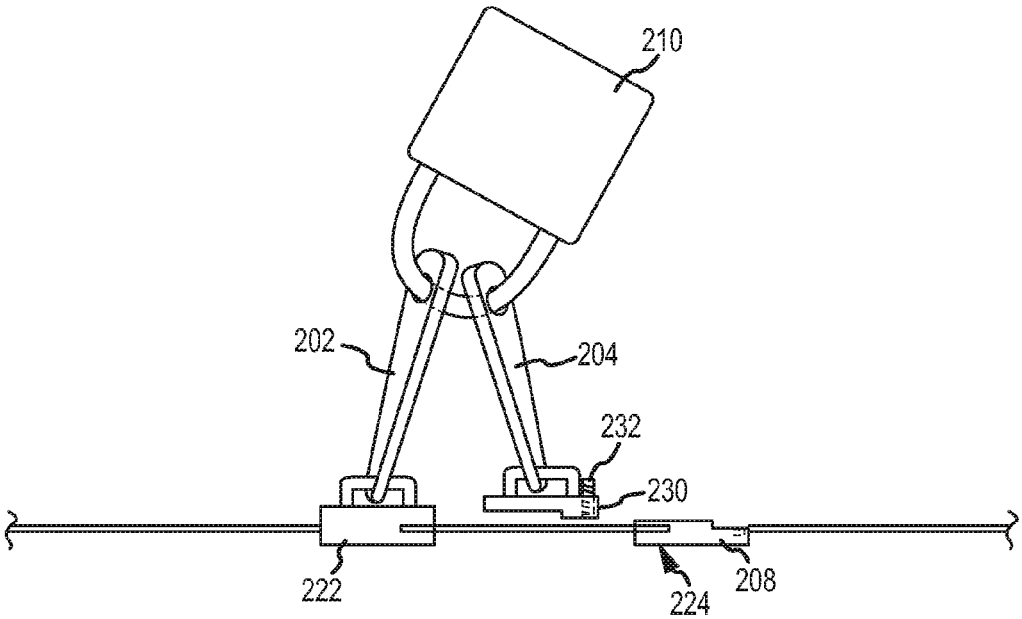
FIG. 2B is a schematic diagram illustrating the first zipper, with the security apparatus remaining joined to pull tabs of the sliders while the first slider is moveable relative to the second slider to provide access to the compartment.

According to one embodiment of the present disclosure, the sliders 222, 224 may be separated to provide access to the secured bag without removal of the locking apparatus 210 by detaching one of the pull tabs 204 and its associated releasable security device 230 from its slider base 208. As shown in FIG. 2B, the pull tab 204 and the releasable security device 230 may be detached from the corresponding slider base 208 of slider 224. Slider 222 and/or slider base 208 may then be independently moved along the zipper track to unzip the zipper. This allows a compartment closed by the zipper to be accessed.

More particularly, the pull tab 204 may be joined to a releasable security device 230. The releasable security device 230, in turn, may be selectively joined to the slider base 208 using a securing member 232, such as a fastener (e.g. a screw or cam or the like). The securing member 232 may be selectively rotated, or otherwise moved, to secure and release the releasable security device 230 to and from the slider base 208. When the releasable security device 230 is released from the slider, the first slider 222 may be moved relative to the second slider base 208 even though the locking apparatus 210 continues to be joined to both pull tabs 202, 204. The first slider 222 and the second slider base 208 can then be independently moved along the zipper track to unzip the zipper. For example, the first slider 222, locking apparatus 210 and second pull tab 204 may be pulled along the zipper track in a manner that unzips the zipper to provide access to a compartment of the luggage. In addition, although the embodiment shown in FIG. 2B shows the second slider 224 as having a pull tab 204 joined to a releasable security device 230, either or both sliders may include the pull tabs joined to releasable security devices such that either pull tab may be separated from its respective slider base in order to allow the sliders to be moved independently along the zipper track to unzip the zipper while the security apparatus remains joined to both pull tabs 202, 204. In this manner, the secured bag may be accessed by an authorized agent during a security check without removing the security apparatus (e.g. the locking apparatus 210) joined to the pull tabs 202, 204.

While one mechanism for allowing the pull tabs 202, 204 to be selectively detached from their corresponding sliders 222, 224 is shown in FIGS. 2A-B, the pull tabs 202, 204 of either slider 222, 224 may be detachable from their corresponding sliders 222, 224 in other ways.

Figure 3A:
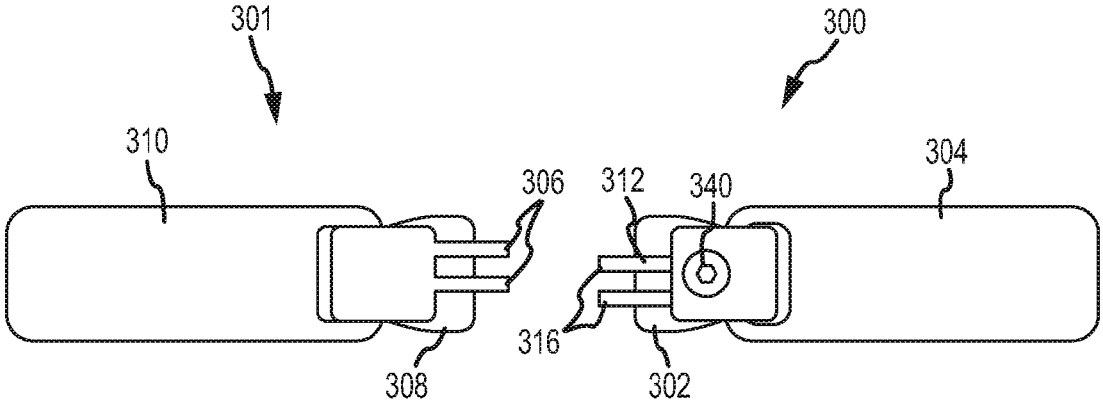
FIG. 3A is a top plan schematic view of second embodiment of a zipper for a luggage compartment.

An alternative embodiment of the zipper may include a slider with a releasable security device that may be configured to receive a security apparatus and to be selectively detached from the slider to provide access to a secured travel bag. For example, FIG. 3A illustrates a second zipper that includes a first slider 300 and a second slider 301. The first and second sliders 300, 301 may be selectively secured together with a security apparatus 320, such as a lock. One of the sliders 300 may include a releasable security device 312 for separating the two sliders 300, 301 when joined by the security apparatus to allow for the sliders to be moved independently along a zipper track to unzip the zipper without first disconnecting the security apparatus from the sliders 300, 301. The releasable security device 312 may include lock portions 316 that extend out and define an aperture through which a locking apparatus may be placed. The first slider 300 may include a slider base 302 and pull tab 304, similar to those components as discussed above. Further, the second slider 301 may also include a slider base 308, a pull tab 310, and one or more lock portions or hasps 306 that extend away from the slider base 308 in the opposite direction of the pull tab 310. In general, the lock portions 306 define an aperture through which a locking apparatus may be placed to secure the sliders 300, 301 to prevent access to a compartment associated with the sliders 300, 301.

Figure 3B:
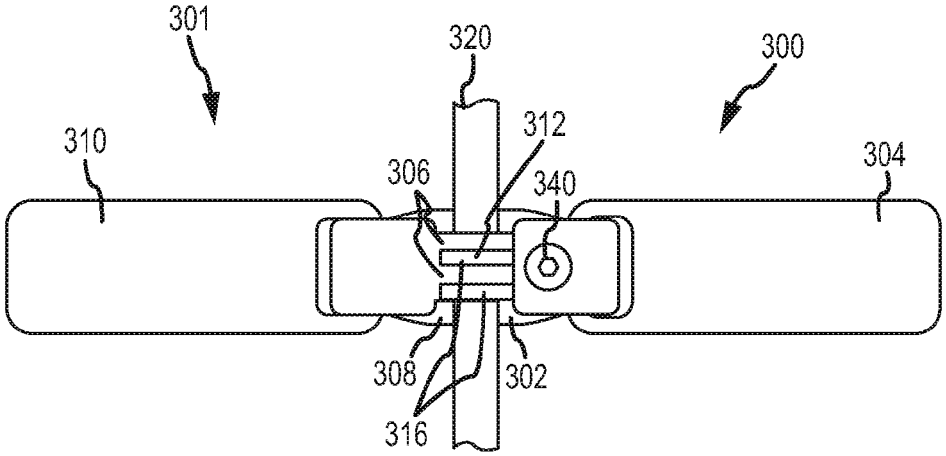
FIG. 3B is a top plan schematic view of the second zipper, with the two sliders of the zipper secured together using a security apparatus.

The lock portions 306 of the second slider 301 may extend from the slider base 308 toward the first slider 300. When the two sliders are brought together, the lock portions 306 may abut a portion of a releasable security device 312 of the first slider 300. More particularly, the lock portions 306 may be oriented to fit between or adjacent to corresponding lock portions 316 of the releasable security device 312 as shown in FIG. 3B. Once positioned, the apertures defined by the lock portions may align to define a passage that may receive a portion of the locking apparatus 320 therethrough to join the two sliders 300, 301 together.

Figure 4A:
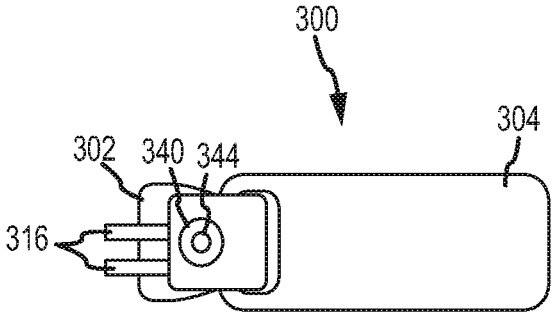
FIG. 4A is a top plan schematic view of the second zipper showing a releasable security device of a slider engaged to a slider base of the slider through a securing member oriented in a locked position.
Figure 4B:
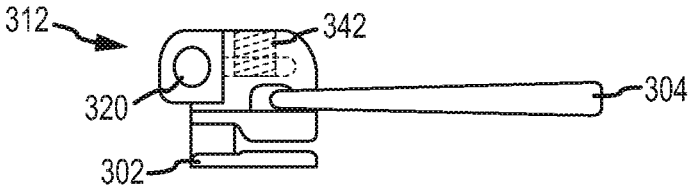
FIG. 4B is a side plan view of the second zipper shown in FIG. 4A.

For example, as shown in the side-view of the second slider in FIG. 4B, one or more lock portions 316 of the releasable security device 312 may define apertures 320 through which a locking apparatus may be placed to secure a first slider 300 to a second slider (not shown in FIG. 4, but analogous to slider 301 in FIGS. 3A and 3B). Thus, returning to FIG. 3B, when the lock portions 306 of the second slider 301 are brought in alignment with the lock portions 316 of the releasable security device 312 of the first slider 300, the apertures may align such that the locking apparatus 320 may be placed through the apertures, thereby securing the two sliders together. To secure a compartment of a travel bag incorporating the embodiment of FIGS. 3A and 3B, the two sliders 300, 301 may be brought together such that the lock portions 306 of the second slider 301 and the lock portions 316 of the releasable security device 312 are adjacent. A locking apparatus 320 may then be placed through the lock apertures of the second slider 301 and the releasable security device 312 of the first slider 300. This configuration provides a similar security function as described above with relation to FIG. 2 such that both sliders move along the zipper track together when either pull tab is pulled along the zipper track.

As mentioned, one of the sliders 300 may include a releasable security device 312 that may be selectively connected to the slider base 302 of the first slider 300. In FIGS. 3A and 3B, the first slider 300 includes such a releasable security device 312. However, either or both sliders may include a releasable security device 312. In general, to access the secured compartment of the luggage while a locking apparatus is in place, the releasable security device 312 may be detached from the slider(s) 300 and/or 301 such that the slider base(s) 302 and/or 308 may be separated along the zipper track. The separation of the slider bases through the detachment of the releasable security device is discussed below with more detail in relation to FIG. 5. In addition, the details of a slider 300 including the releasable security device 312 can be seen in FIGS. 4A through 4D.

With reference to FIGS. 4A and 4B, the first slider 300 may include a slider base 302 for interlocking the teeth of a zipper, and a pull tab 304 to aid in translating the slider along the zipper track to engage and disengage the interlocking teeth. In addition, the slider 300 may include a releasable security device 312 engaged with the slider base through a securing member, such as a fastener 340, positioned proximate a top portion of the slider 300. The securing member may be a cam, a screw, or the like. The securing member 340 may be rotated to attach and detach the releasable security device 312 from the slider base 302.

As shown in FIGS. 4A through 4D, the releasable security device 312 may include one or more lock portions 316 to engage a locking apparatus as described above. In general, the lock portions 316 of the releasable security device 312 may define an aperture 320 through which a locking apparatus may be placed to affix the slider 300 to a separate slider of the zipper, as shown in FIG. 3B.

Figure 4C:
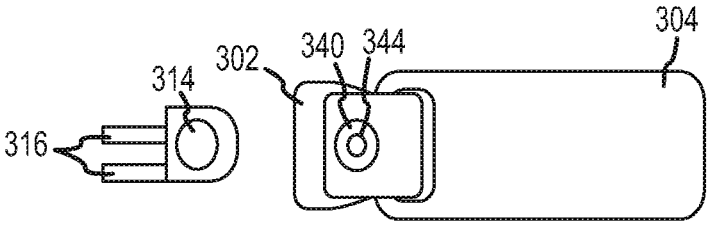
FIG. 4C is a top plan view of the second zipper showing the releasable security device disengaged from the slider base.
Figure 4D:
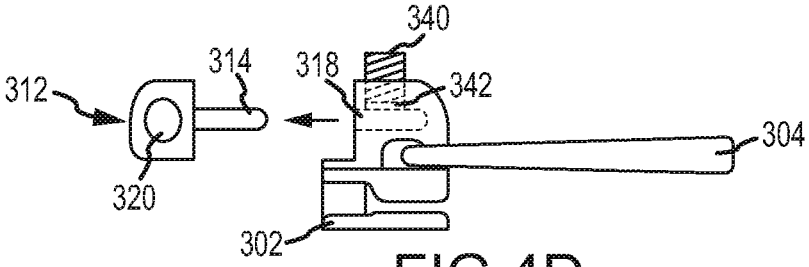
FIG. 4D is a side plan view of the second zipper shown in FIG. 4C.

With reference to FIGS. 4C and 4D, the slider 300 may include a slot 318 or opening near the top of the slider. The slot 318 may extend into the slider 300 from a surface of the slider base 302 that faces opposite the pull tab 304 of the slider 300. The slot 318 may be configured to accept a portion of the releasable security device 312 oriented transverse to the lock portions 316. This portion of the releasable security device 312 may include an engagement hole 314. In general, the engagement hole 314 of the releasable security device 312 may be inserted into the slot 318 such that the lock portions 316 of the releasable security device 312 lay flush against the slider base 302, as shown in the side view of FIG. 4B. When the releasable security device 312 is placed in the slot 318, the securing member 340 can be positioned within the engagement hole 314 to secure the releasable security device to the slider 300. When positioned within the engagement hole 314, the securing member engages the releasable security device 312 to prevent the releasable security device from being separated from the slider 300.

As mentioned, the securing member 340 may be positioned proximate the top portion of the slider 300. In the embodiment shown in FIG. 4A through 4D, the securing member 340 may be a screw-type fastener, including threads disposed along at least a portion of the length of the fastener. In addition, the slider 300 may include a threaded guide hole 342 located in the top portion of the slider 300 that accepts and operates with the securing member 340 to lower and raise the securing member within the guide hole. Thus, rotation of the securing member 340 in one direction within the guide hole 342 may cause the securing member to rise, while rotation of the securing member in the opposite direction may case the securing member to lower, similar to a typical screw-type fastener. To aid in the rotation of the securing member 340, the securing member may include a head 344 with one or more indentions. For example, the securing member 340 may include a hexadecimal head such that a hex-key or hex-screwdriver may be used to rotate the securing member within the guide hole 342. In general, however, the securing member 340 may include any type of screw head, including a flat head, Phillips, square and so on.

To secure the releasable security device 312 to the slider 300, a connection portion of the releasable security device may be positioned within the slot 318 such that an engagement hole 314 defined in the connection portion co-axially aligns with the guide hole 342. Once the engagement hole 314 is in this position, the securing member 340 may be rotated within the threaded guide hole 342 to lower the securing member through the engagement hole 314. In this manner, the releasable security device 312 may be secured to the slider 300. The slider 300 may be attached to another slider by a locking apparatus, as shown above, utilizing the lock portions 316 of the releasable security device 312 and the lock portions 306 of the other slider. To detach the releasable security device 312 from the slider 300, the securing member 340 may be rotated within the threaded guide hole 342 until the securing member is no longer received within the engagement hole 314. At this point, the releasable security device 312 may be removed from the slot 318 as shown in FIG. 4B. The securing member 340 may be rotated by engaging the head at the top of the securing member 340 with an appropriate tool, such as a screwdriver with a hexadecimal end.

Figure 5:
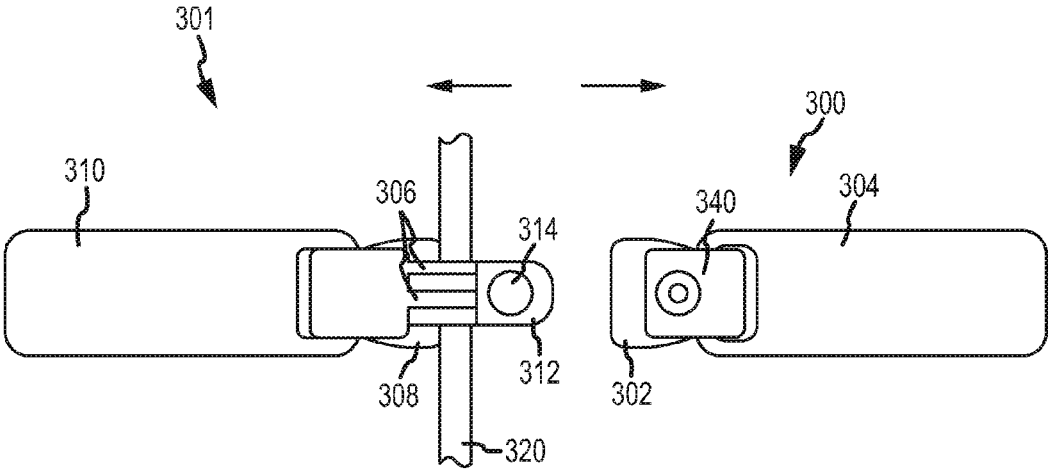
FIG. 5 is a top plan view of the second zipper illustrating separation of the two sliders by disengaging the releasable security device from the second slider.

The operation of the releasable security device 312 in relation to a piece of luggage is illustrated in FIG. 3B and FIG. 5. As discussed above, FIG. 3B is a top plan view of a first slider 300 and a second slider 301 of a zipper. The sliders 300, 301 are affixed together by a locking apparatus 320 placed through apertures defined in lock portions of the slider and releasable security device 312 that extend away from the sliders 300, 301. In operation, separation of the two sliders 300, 301 when joined by a locking apparatus, such as a lock, may be achieved by disengaging the releasable security device 312 from the first slider 300. The detachment of the releasable security device from the first slider is shown in FIG. 5.

FIG. 5 is a top plan view of a first slider 300 and second slider 301 of the zipper illustrating separation of the two sliders by disengaging a releasable security device 312 from the first slider. As shown in this embodiment, the releasable security device 312 may be disengaged from the first slider 300 as described above such that the two sliders may be separated along the zipper track to access a compartment of the luggage.

In one example, the releasable security device 312 may provide access to a secured travel bag in the following manner. As shown in FIG. 3B, the two sliders 300, 301 may be secured together by a locking apparatus 320. However, as mentioned above, one or more governmental agencies may require access to the compartments of the travel bag during security checks. To access the compartments, an agent may utilize a key or other interfacing device to rotate the securing member 340 present on the top of the first slider 300. As illustrated in FIGS. 4C and 4D, rotating the securing member 340 elevates the securing member within the threaded guide hole 342. Thus, the securing member 340 may be rotated by the agent until it disengages with the engagement hole 314 of the releasable security device 312. Returning to FIG. 5, once the securing member is disengaged with the releasable security device 312, the releasable security device may removed from the first slider 300 while maintaining the locked configuration with the first slider 300. The two sliders 300, 301 may then be separated by the agent to access the secured compartment of the travel bag.

To re-secure the bag after the security check, the two sliders may be brought back together such that that the releasable security device 312 re-engages within the slot of the second slider 301. The agent may then rotate the securing member 340 utilizing the head to reseat the securing member within the engagement hole 314 of the releasable security device 312. Thus, the two sliders 300, 301 may be reengaged and the compartment of the luggage may be re-secured. Further, while the above example provides for the releasable security device 312 to be disposed on the first slider 300, it should be appreciated that either or both sliders (300, 301) may incorporate a releasable security device 312. In addition, the securing member 340 and releasable security device 312 may take many shapes and embodiments. Some additional examples of alternative embodiments of the securing member 340 and releasable security device 312 are discussed below in reference to FIGS. 6A through 20B.

Figure 6A:
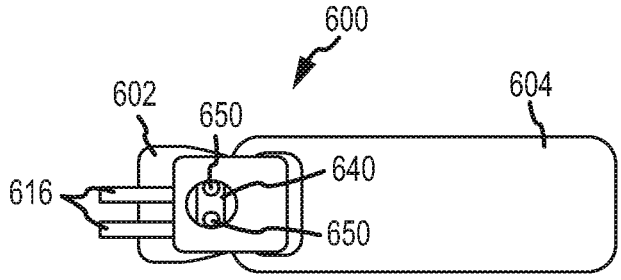
FIG. 6A is a top plan view of a third zipper showing a releasable security device engaged with a slider base of a slider through a securing member oriented in a locked position.
Figure 6B:
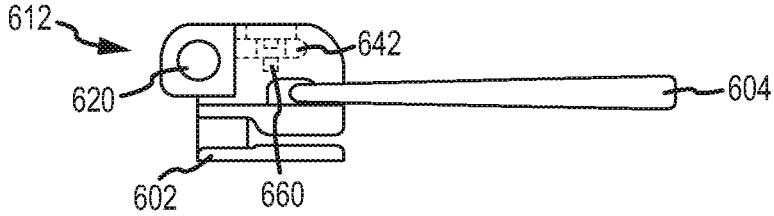
FIG. 6B is a side plan view of the third zipper shown in FIG. 6A.

FIGS. 6A and 6B are top plan and side views of a third zipper. In general, the components of the embodiment shown in FIGS. 6A and 6B are similar to the components of the sliders discussed above and operate in a similar manner. However, in this embodiment, the releasable security device 612 and securing member 640 may operate in a different manner to provide the securing and releasable nature of the releasable security device.

Similar to the embodiments discussed above, the slider 600 shown in FIGS. 6A and 6B may include a hole 642 located in the top portion of the slider with a securing member 640 disposed therein. However, rather than including a threaded guide hole and corresponding threaded screw-type device, the securing member 640 of the embodiment of FIGS. 6A and 6B may be a cam or the like rotatably positioned within the hole 642. In other words, the securing member 640 may not be removed from the slider base 602, but may rotate within the hole around an axis defined by an axle 660 extending from the main body of the securing member 640. In one embodiment, the securing member 640 may rotate freely within the hole 642 around the axis. In another embodiment, one or more stops (not shown) may be disposed within the hole 642 to limit the rotation of the securing member 640 between a locked and an unlocked position. Further, one or more bias members (not shown) may also be disposed within the hole 642 to bias the securing member 640 in either the locked or the unlocked position.

Figure 8:
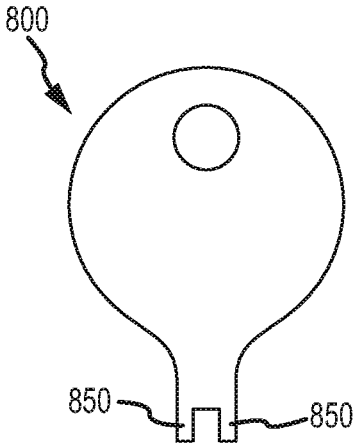
FIG. 8 is a side view of a key for rotating the securing member to release the releasable security device of the third zipper.

In this embodiment, the securing member 640 may include one or more indentations 650 to aid in rotation of the securing member 640. For example, a key device 800 is shown in FIG. 8 that includes two protrusions 850 extending away from the key body. The key 800 shown in FIG. 8 is but one example of a key-type device that may be utilized to rotate the securing member 640 of the slider 600. Returning to FIG. 6A, the securing member 640 may include two indentions 650 that receive the protrusions 850 of the key device 800 shown in FIG. 8. Thus, to rotate the securing member 640 within the hole 642, a user may engage the protrusions 850 of the key 800 into the matching indentations 650 of the securing member 640 and apply pressure to the key to rotate the securing member. In general, and as discussed above, the securing member 640 may include any suitable configuration to communicate with a key or screwdriver device that allows a user to rotate the securing member. In an additional example, the securing member may include one or more protrusions that may be engaged and rotated by a user's fingers to rotate the securing member 640.

Figure 6C:
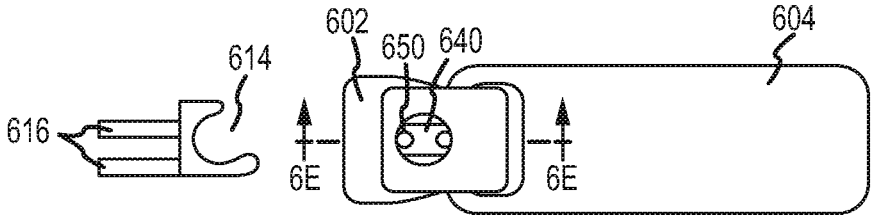
FIG. 6C is a top plan view of the third zipper showing the releasable security device disengaged from the slider base.
Figure 6D:
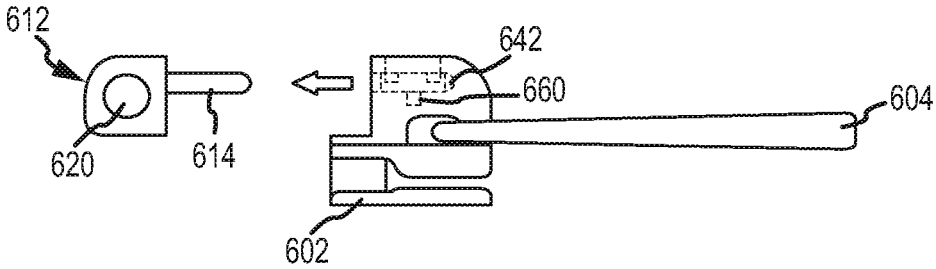
FIG. 6D is a side plan view of the third zipper shown in FIG. 6C.

In addition and as shown in FIGS. 6C and 6D, the engagement hole 614 of the releasable security device 612 of this embodiment may form a partial circle extending at a right angle from the lock portions 616 of the device. Similar to the embodiments described above, the engagement hole 614 may be positioned within the hole 642 defined in the slider 600. In general, the configuration of the releasable security device 612 is similar to those embodiments described above with relation to FIGS. 3A through 5, except the engagement hole 614 of this embodiment forms a partial-circle. The open portion of the engagement hole 614 allows for the releasable security device 612 to engage and disengage with the securing member 640 without needing to remove the securing member from the engagement hole. For example, as described above, the securing member 640 of the embodiment of FIGS. 6C and 6D may be rotatable within the hole 642 without raising or lowering the securing member 640 relative to the slider base. Thus, insertion of the releasable security device 612 into the hole 642 may abut the securing member 640 to the portion of the releasable security device 612 defining the engagement hole 614. The open portion of the engagement hole 614 allows for the securing member 640 to slide into the engagement hole 614 as the releasable security device 612 is positioned within the slider 600. The engagement of the securing member 640 with the releasable security device 612 to attach the releasable security device within the slider 600 is discussed below in relation to FIGS. 7A and 7B.

Figure 6E:
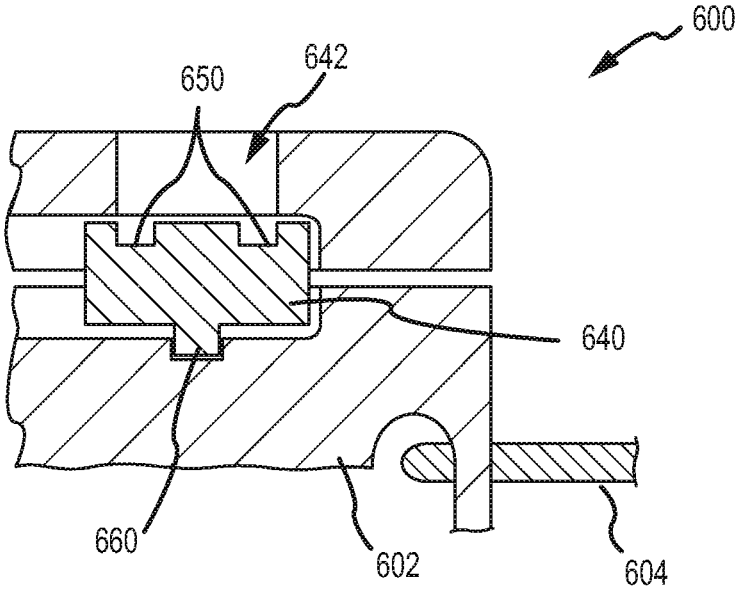
FIG. 6E is an exploded cross-section view of a portion of the zipper slider of FIGS. 6A through 6D, viewed along line 6E-6E in FIG. 6C.

With reference to FIG. 6E, to assemble, the axle 660 of the securing member 640 may in one embodiment be received within the axle bearing recess defined in the lower portion of the slider base 602. The upper portion of the slider base 602 may then be positioned to abut the lower portion of the slider base 602. The abutting edges of each position may then be joined by a suitable connection method such as using adhesives, sonic welding, and so on. Many other assembly methods are also possible, including those without an upper and lower portion of the slider base 602.

Figure 7A:
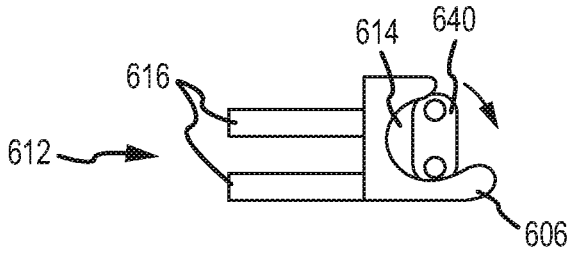
FIG. 7A is a top plan view of the releasable security device of the third zipper showing the releasable security device engaged with a securing member oriented in a locked position; the slider of the third zipper is not shown in FIG. 7A in order to better show the securing member and releasable security device.

FIG. 7A is a top plan view of a releasable security device of the third zipper with the securing member oriented to secure the releasable security device to the slider base of the slider. In order to better shown the securing member and the releasable security device, the zipper slider is not shown in FIGS. 7A and 7B. To secure the releasable security device 612 within the slider, the securing member 640 may be oriented in a locked position within the slider. In this orientation, the releasable security device 612 may be prevented from being extracted (moved to the left in the figure) from the slider base. More particularly, the engagement hole 614 of the releasable security device 612 may include a securing nub 606 that forms a portion of the partial-circle of the engagement hole. When the releasable security device 612 is pulled (such as in an attempt to separate two sliders of a zipper), the securing nub 606 contacts a surface of the securing member 640. This engagement prevents the extraction of the releasable security device 612. Therefore, as long as the securing member 640 remains in the locked position, the releasable security device 612 is attached to the slider base by the securing member 640.

Figure 7B:
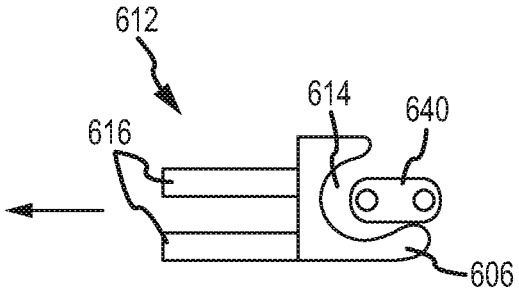
FIG. 7B is a top plan view of the releasable security device of the third zipper with the securing member oriented in an unlocked positioned to allow for the release the releasable security device from the slider base of the slider; the slider of the third zipper is not shown in FIG. 7B in order to better show the securing member and releasable security device.

To release the releasable security device 612, the securing member 640 may be rotated within the securing member housing to its unlocked position. As shown in FIG. 7B, when the securing member 640 is oriented in an unlocked position, the securing nub 606 of the releasable security device 612 no longer abuts the surface of the securing member and so the releasable security device may be allowed to pass by the securing member as the security device is pulled to the left and extracted from the slider base. In this manner, by orienting the securing member 640 in the unlocked position, the releasable security device 612 may be extracted from the slider to provide access to a compartment of the luggage.

Another embodiment of the present disclosure is shown in FIGS. 9A through 9D. In general, the components of the embodiment shown in FIGS. 9A through 9D are similar to the components of the embodiment discussed above with relation to FIGS. 6A through 6D. However, in this embodiment, the securing member includes a keyhole indention 950. Operation of the releasable security device 912 is similar to that described above. However, in this embodiment, a user may insert a key that matches the keyhole 950 disposed on the securing member 940 to rotate the securing member within the hole 942. In addition, the hole 942 may include one or more tumblers that align with the keyhole 950 provided on the head of the securing member 940 such that only a key that matches the keyhole may be utilized to rotate the securing member within the housing and release the releasable security device 912.

Figure 9A:
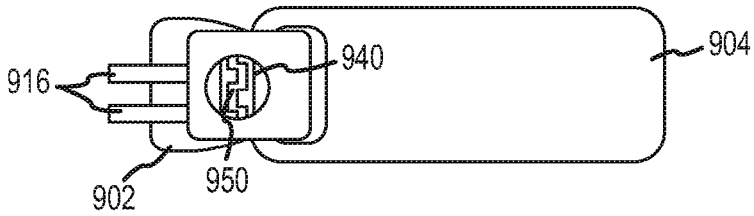
FIG. 9A is a top plan view of a fourth zipper showing a slider including a releasable security device engaged to a slider base of the slider through a keyed securing member oriented in a locked position.
Figure 9B:
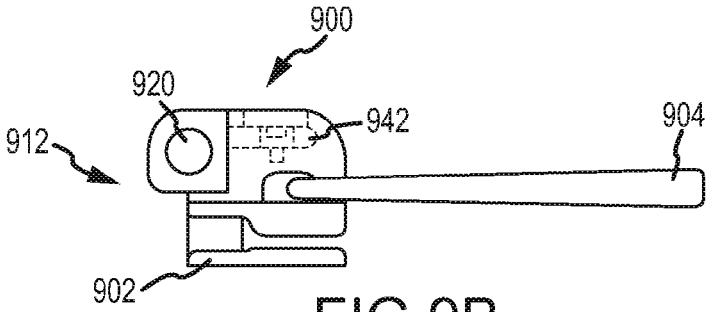
FIG. 9B is a side plan view of the fourth zipper shown in FIG. 9A.
Figure 9C:
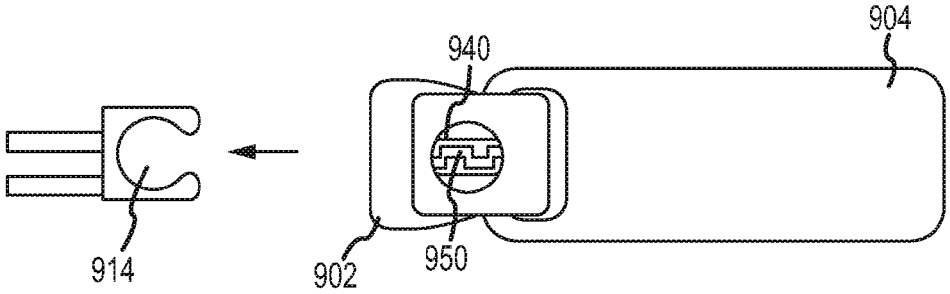
FIG. 9C is a top plan view of the fourth zipper showing the releasable security device disengaged from the slider base of the slider.
Figure 9D:
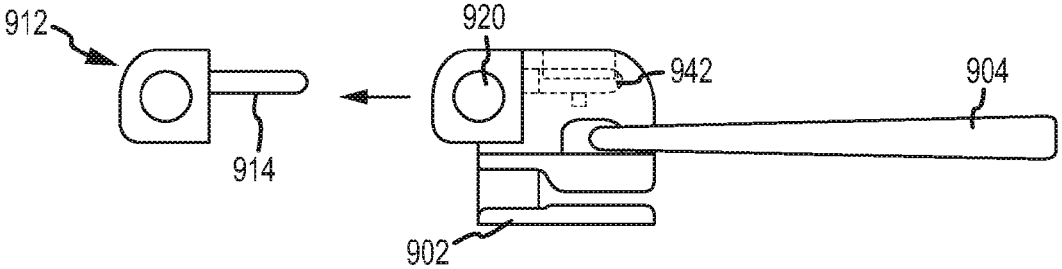
FIG. 9D is a side plan view of the fourth zipper shown in FIG. 9C.
Figure 10A:
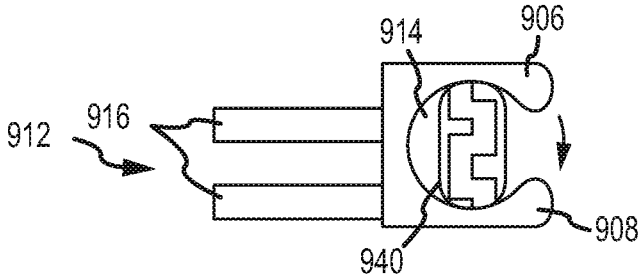
FIG. 10A is a top plan view of the releasable security device of the fourth zipper with the securing member oriented in a locked position to secure the releasable security device to the slider base of the slider.

In addition, the engagement hole 914 of the embodiment of FIG. 9C may form a partial-circle with two securing nubs that abut the securing member 940 to hold the releasable security device 912 within the slider 900. For example, as shown in FIG. 10A, the securing member 940 of this embodiment may be oriented in the locked positioned within the hole. In order to better shown the securing member and the releasable security device, the zipper slider is not shown in FIGS. 10A and 10B. In this orientation, the releasable security device 912 may be prevented from being extracted (moved to the left in the figure) from the slider base by upper securing nub 906 and lower securing nub 908 of the engagement hole 914. Thus, when the releasable security device 912 is pulled (such as in an attempt to separate two sliders of a zipper), the securing nubs 906, 908 engage the surface of the securing member 940 and prevent the extraction of the releasable security device 912.

Figure 10B:
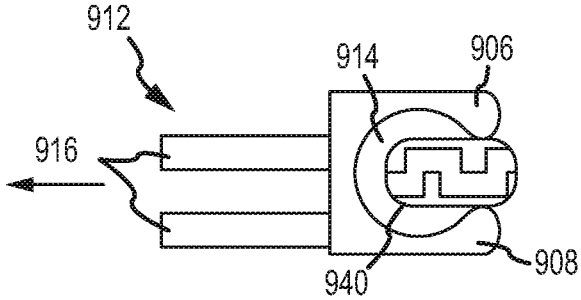
FIG. 10B is a top plan view of the releasable security device of the fourth zipper with a securing member oriented in an unlocked position to allow for the release the releasable security device from the slider base of the slider.

To release the releasable security device 912, the securing member 940 may be rotated within the hole into an unlocked position. As shown in FIG. 10B, when the securing member 940 is oriented in the unlocked position, the securing nubs 906, 908 of the releasable security device 912 may no longer abut the securing member such that the releasable security device 912 may be allowed to pass by the securing member as the security device is pulled to the left and extracted from the slider base. In this manner, by orienting the securing member 940 in the unlocked position, the releasable security device 912 may be extracted from the slider base to provide access to a compartment of a travel bag.

As should be appreciated, the features of the embodiments provided herein may be combined in many fashions. For example, the releasable securing device illustrated in FIGS. 9A through 10B may be utilized in the slider embodiment illustrated in FIG. 6A. Similarly, the securing member of FIG. 10B utilizing a keyhole may be the securing member for any of the embodiments described herein. In general, any component of the embodiments described herein may be used in other embodiments as desired. Further, the examples used herein are but a few possible embodiments for the zipper.

Figure 11:
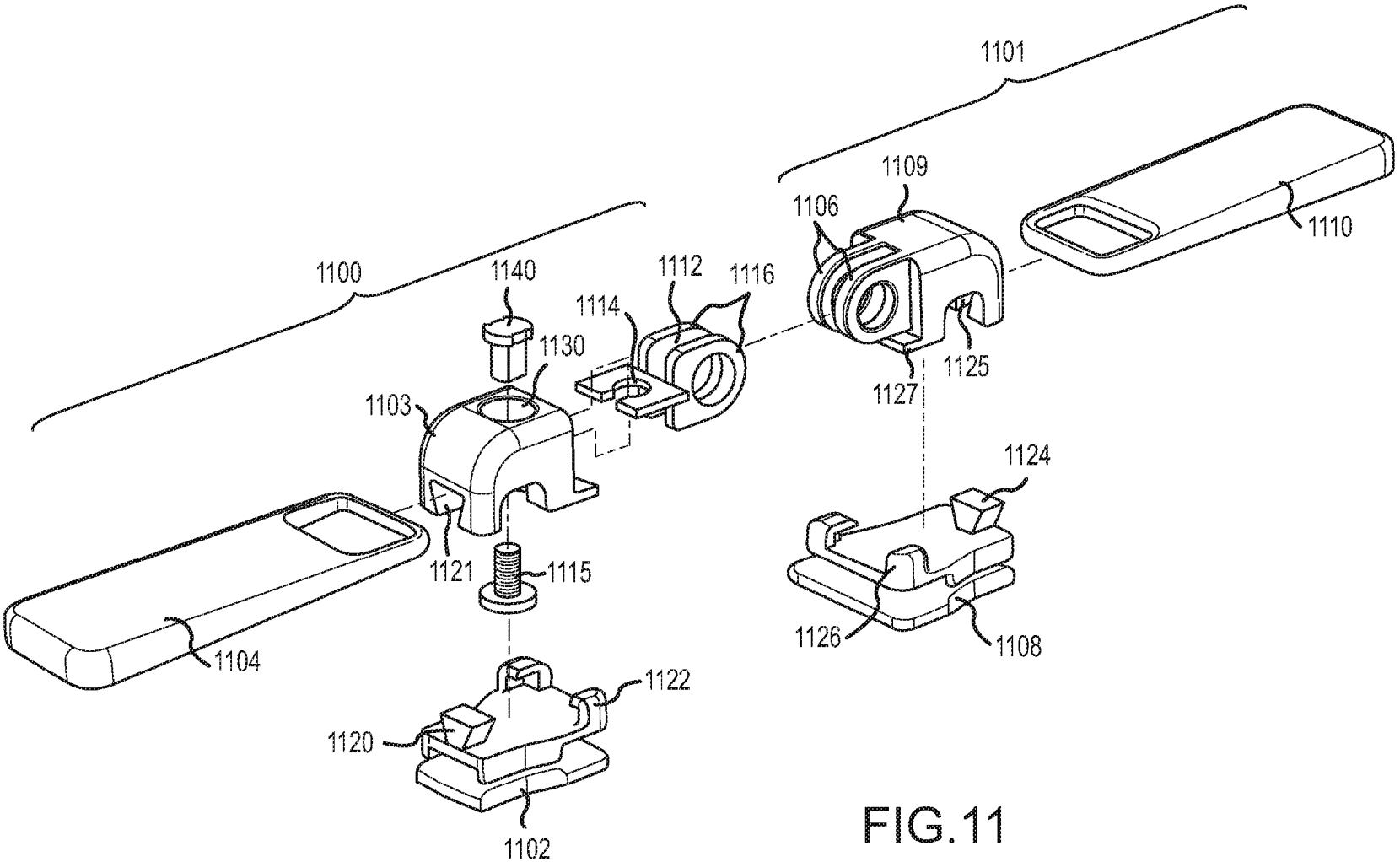
FIG. 11 is an exploded perspective view of a fifth zipper showing a slider including a releasable security device and a slider with a non-releasable security device.

FIGS. 11 through 14 demonstrate one another embodiment of a zipper. FIG. 11 shows an exploded view of one embodiment of the zipper. The zipper may include a first slider 1100 and a second slider 1101. The first slider 1100 may include a slider lower portion 1102 with a dovetail projection 1120 on one side and at least one flange 1122 on the distal side of the slider lower portion. Slider lower portion 1102 with dovetail 1120 and flange 1122 may be manufactured as one piece by using, for example, a molding technique. The first slider 1100 may also include a pull tab 1104, and a slider upper portion 1103. Furthermore, the first slider upper portion 1103 may be joined to a releasable security device 1112 by a securing member 1140 (such as a cam, a screw, a fastener, and the like), which may be joined to the slider upper portion via a fastener 1115, such as a screw or the like. The releasable security device 1112 may be similar to the releasable security devices shown and described with reference to FIGS. 3 through 10. The securing member 1140 may include a head and a shaft. The head may be configured for engagement with a key or other like device. The shaft may extend from the head and may define a hole sized to receive the fastener 115.

Slider 1100 may be assembled by first securing the releasable security device 1112 to the slider upper portion 1103 by inserting the releasable security device into the slot (not visible in FIG. 11) in the slider upper portion such that the engagement hole 1114 aligns with the aperture 1130 in the slider upper portion. Securing member 1140 is then placed in the aperture 1130 in the slider upper portion and through the engagement hole 1114 of the releasable security device 1112. Fastener 1115 is then fastened to securing member 1140 by, for example, screwing the fastener into the securing member.

Once the releasable security device 1112 is joined to the slider upper portion 1103 via the securing member 1140 and fastener 1115, slider upper portion 1103 may be joined to the slider lower portion 1102 with the pull tab 1104 positioned between the slider upper portion and the slider lower portion. In particular, the pull tab 1104 may be positioned on the slider lower portion such that the dovetail projection 1120 extends beyond the aperture of the pull tab. The slider upper portion 1103 may then be joined to the slider lower portion 1102 by sliding a slider upper portion protrusion 1123 into the flange 1122 on the slider lower portion while at the same time sliding the slider upper portion dovetail aperture 1121 onto the dovetail projection 1120 of the slider lower portion. The upper slider portion may be joined to the slider lower portion by any suitable connection method such as using adhesives or welding the parts together. The dovetail projection 1120 and the flange 1122 provide physical barriers that reinforce the connection between the slider upper portion 1103 and the slider lower portion 1102. Specifically, the dovetail projection inhibits the slider upper portion from being pulled up perpendicularly from the slider lower portion, as does the flange. The slider upper portion and slider lower portion also provide more surface area over which adhesive, welding, etc. may be applied, which may further strengthen the bond between the slider upper portion and the slider lower portion.

Although FIG. 11 demonstrates one embodiment of mechanical connections between the slider upper portion 1103 and the slider lower portion 1102, many configurations of mechanical connections may be employed. For example, the slider lower portion could include a dovetail aperture (i.e. a female-type receptacle) while the slider upper portion could include a dovetail projection (i.e. a male-type connector). Many other mechanical connections which strengthen the bond between the slider lower portion and slider upper portion could similarly be employed. Also, the assembly instructions described above may be performed in any suitable order; for example, the slider lower portion 1102 and slider upper portion 1103 may be assembled with the pull tab 1104, and the securing member 1140 and screw 1115 before joining the releasable security device 1112 to the slider upper portion. Also, the modular nature of the slider upper portion 1103 and slider lower portion 1102 facilitates the manufacture and the assembly of a zipper. For example, the modular nature of the slider upper portion and slider lower portion facilitates joining the releasable security device 1112, the securing member 1140, and fastener 1115 to the slider upper portion 1103 as shown in FIGS. 11 through 14, and as described herein. The modular nature also allows for different shapes and types of slider upper portions to be joined to a common slider lower portion. Such flexibility allows for different security devices or features to be added to a zipper slider while maintaining a slider lower portion that may be mass-manufactured. Such flexibility also allows for relatively easy replacement of the slider upper portion without replacing the slider lower portion.

Still with reference to FIG. 11, the second slider 1101 may be assembled in a similar manner to slider 1100. Although FIG. 11 shows a second slider 1101 that does not include a releasable security device, both sliders 1100 and 1101 may include releasable security devices. As shown in FIG. 11, however, only slider 1100 includes a releasable security device. Slider 1101 in FIG. 11 may include a slider lower portion 1108 with a dovetail projection 1124 on one side and a flange 1126 on the distal side of the slider lower portion. Slider lower portion 1108 may be manufactured as one piece by using, for example, a molding technique. The second slider 1101 may also include a pull tab 1110, and a slider upper portion 1109. The slider upper portion may include lock portions 1106 configured to align with the lock portions 1116 of the releasable security device 1112. Slider 1101 may be assembled in a manner similar to the assembly of slider 1100 as described above, and as shown in FIG. 11.

Figure 12:
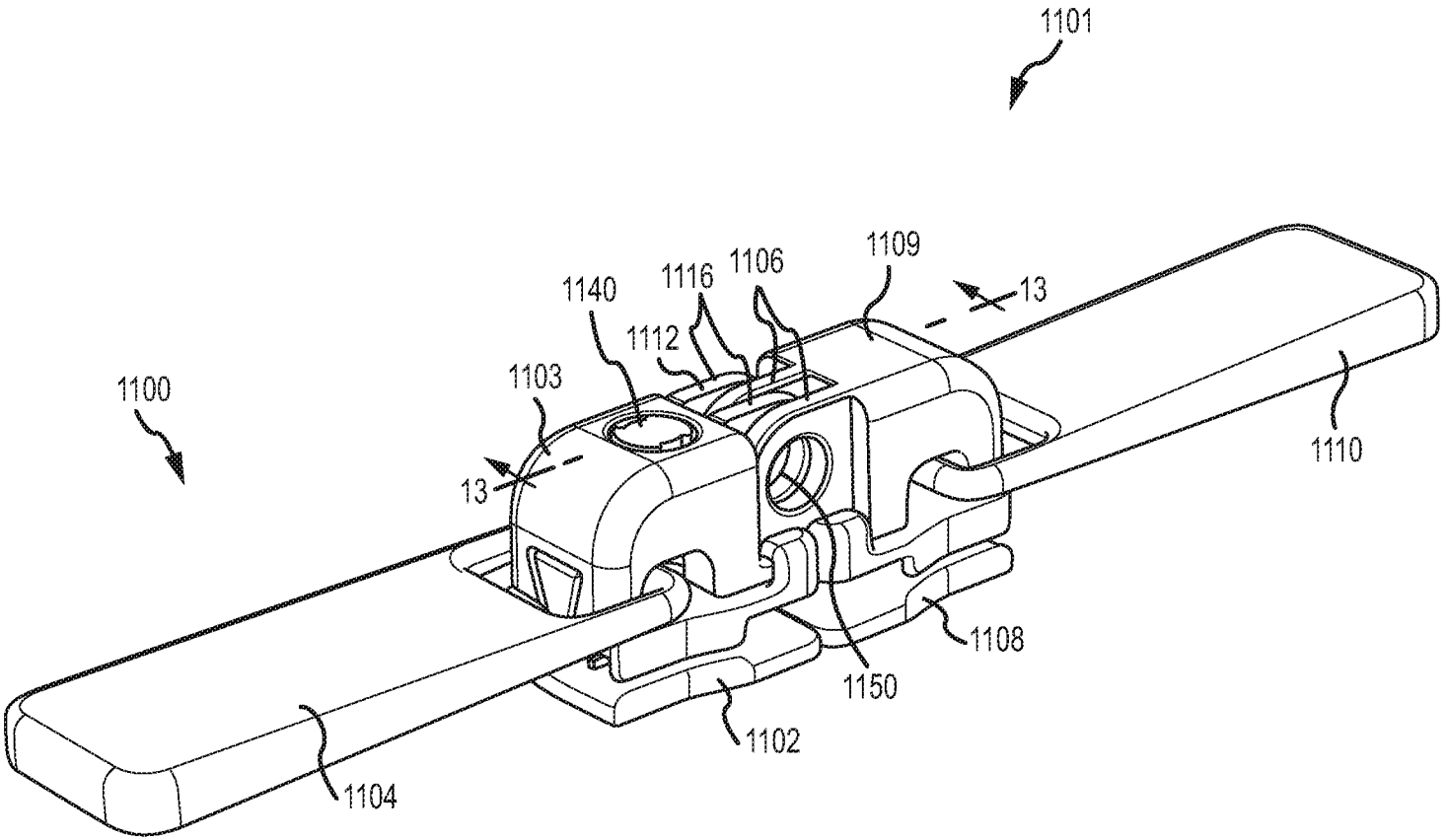
FIG. 12 is a perspective view of the zipper of FIG. 11, showing the two zipper sliders joined so that a security apparatus may be placed therethrough.

With reference to FIG. 12, sliders 1100 and 1101 are shown assembled and positioned such that a security apparatus, such as a lock, may be placed in the aperture 1150 defined by the lock portions 1116 of the releasable security device 1112 and the lock portions 1106 of the slider upper portion 1109.

Figure 13:
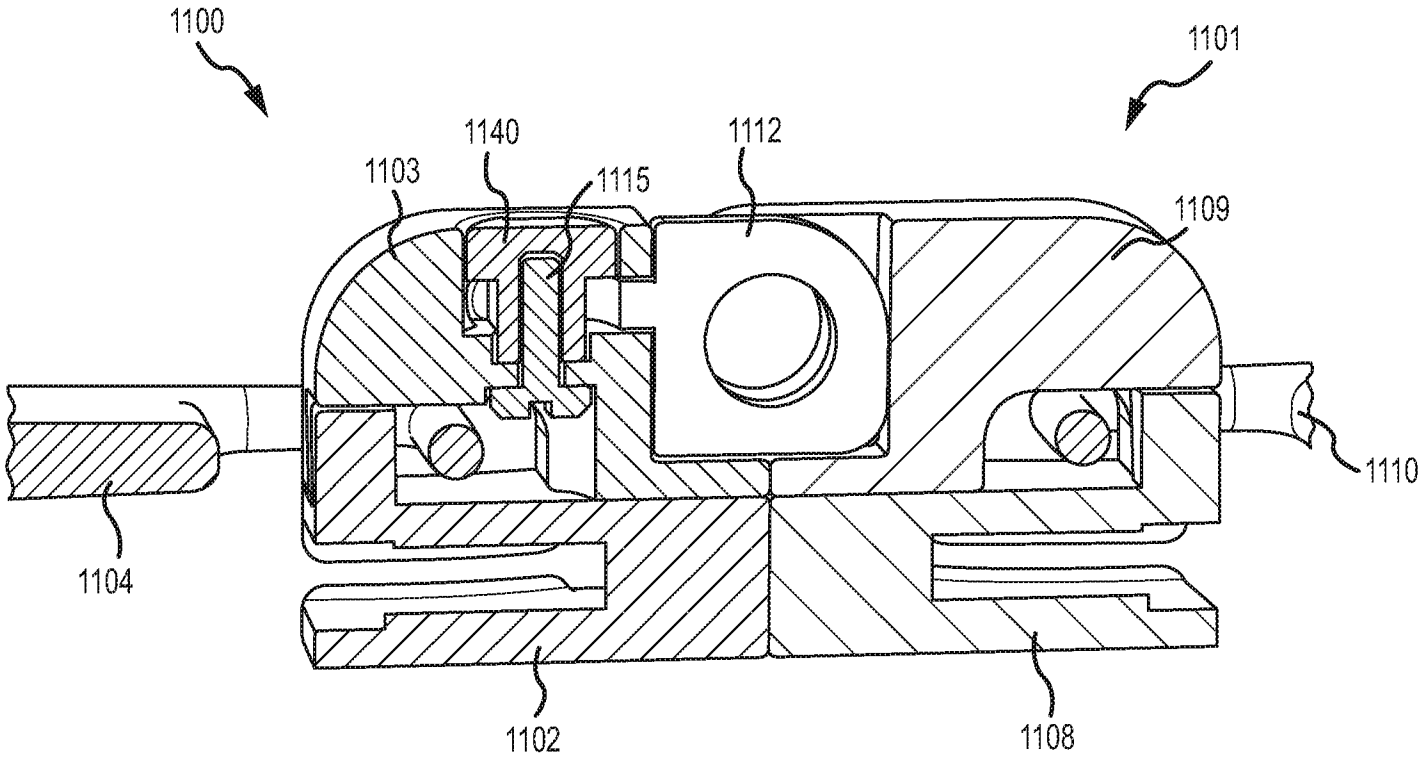
FIG. 13 is a cross-section view of the zipper of FIG. 11, viewed along line 13-13 of FIG. 12.
Figure 14:
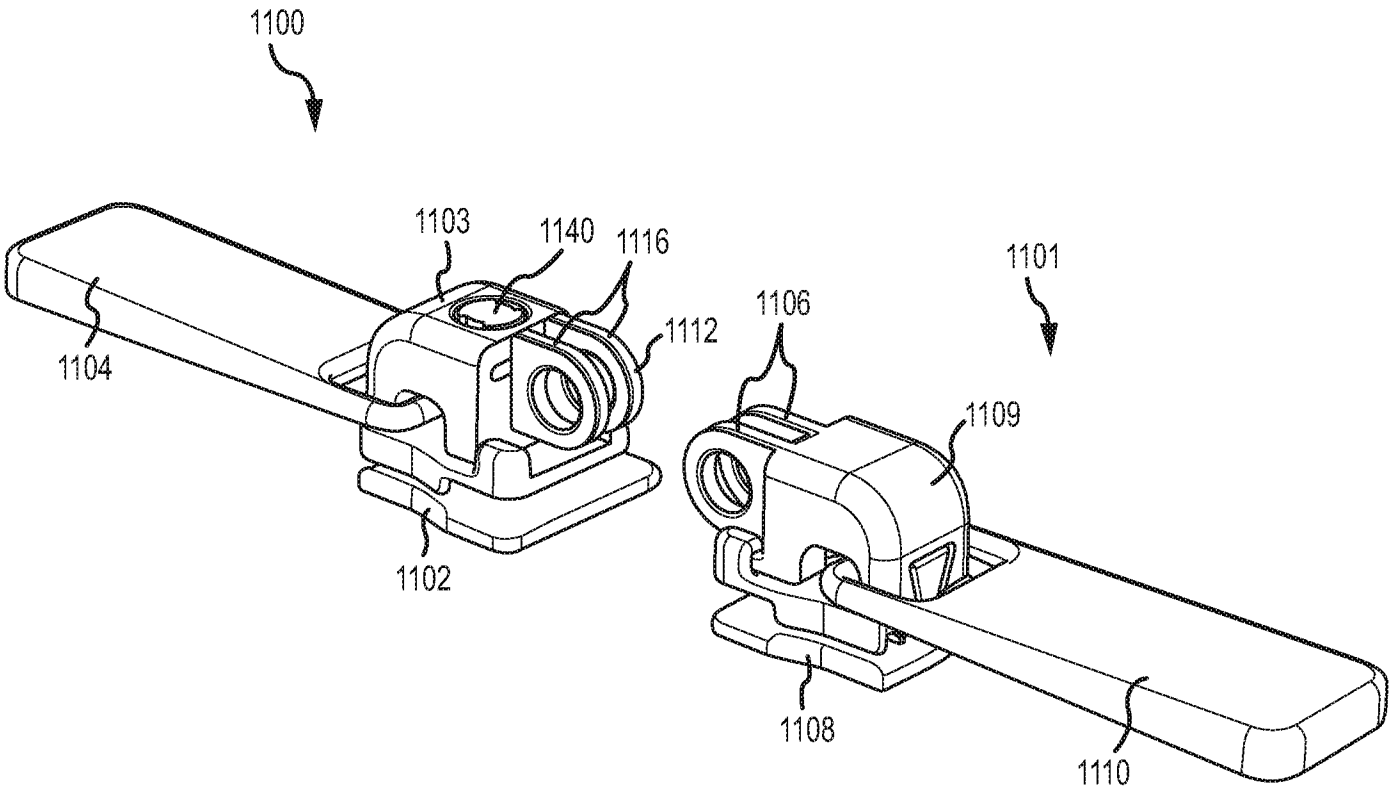
FIG. 14 is a perspective view of the zipper of FIG. 11, showing the two sliders separated from each other.

FIG. 13 shows a cross section view of fully assembled sliders 1100 and 1101 along line 13-13 of FIG. 12. In particular, FIG. 13 shows releasable security device 1112 joined to slider upper portion 1103 via a securing member 1140 and fastener 1115. The aperture in the slider upper portion 1103 may be configured so that fastener 1115 and securing member 1140 engage a portion of the slider upper portion. In some embodiments, and as shown in FIG. 13, the securing member and fastener may surround or 'sandwich' a protrusion of the slider upper portion. The friction between the securing member and the slider upper portion may prevent the securing member from rotating and keep the releasable security device 1112 in place. However, the friction force may be overcome by turning the securing member 1140 (for example with a key that matches the securing member's head), thereby allowing the securing member and the fastener to rotate within the aperture. When the securing member 1140 is rotated to a predetermined position, the releasable security device 1112 may be removed from the slider upper portion 1103. Similarly, when a user desires to rejoin the releasable security device with the slider upper portion, the releasable security device may be inserted into the slot in the slider upper portion, and the securing member 1140 may be rotated to another predetermined position, thereby securing releasable security device 1112 to the slider upper portion 1103. FIG. 14 shows sliders 1100 and 1101 separated.

Figure 15:
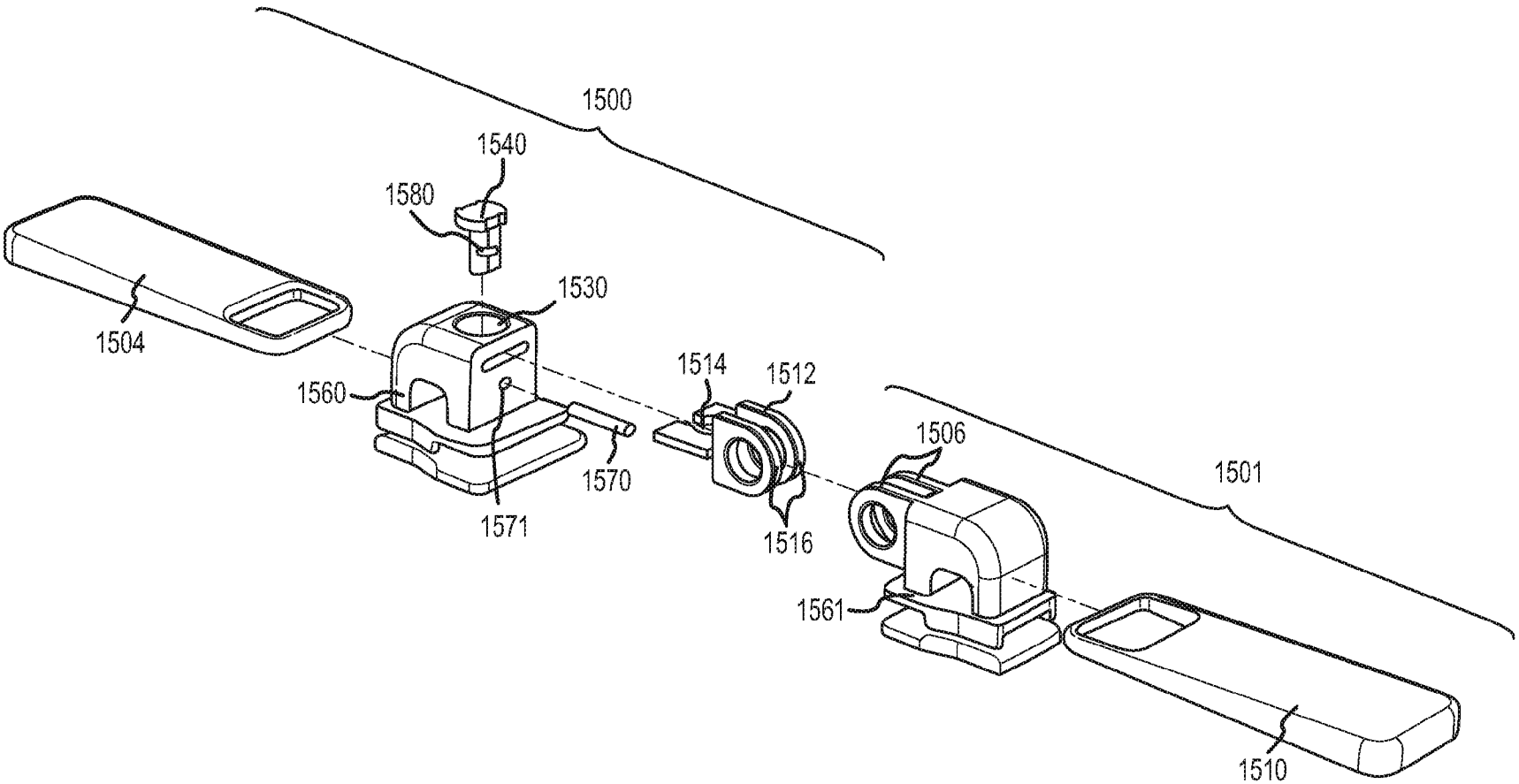
FIG. 15 is an exploded perspective view of a sixth zipper showing a slider including a releasable security device and a slider without a releasable security device.

FIGS. 15 through 19 demonstrate another zipper. FIG. 15 shows an exploded view of the zipper. The zipper may include a first slider 1500 and a second slider 1501. A first slider 1500 may include a slider base 1560. The slider base 1560 may be manufactured as one piece by using, for example, a molding technique. The first slider 1500 may also include a pull tab 1504. Furthermore, the first slider base 1560 may be joined to a releasable security device 1512 by a securing member 1540, which may be joined to the slider base via a pin 1570. The releasable security device 1512 may in some embodiments be similar to the releasable security devices shown and described with reference to FIGS. 3 through 15. The securing member 1540 may include a head and a shaft. The head may be configured for engagement with a key or other like device, as explained in detail below. The shaft may extend from the head and may define one or more holes or notches configured to receive the pin 1570, as explained in more detail below.

Slider 1500 and releasable security device 1512 may be assembled by first joining the securing member 1540 to the slider base 1560 using a pin 1570. Specifically, the securing member may be placed in the aperture 1530 in the slider base so that the notches 1580 are aligned with the hole 1571 in the slider base. The pin 1570 may then be placed in the hole 1571 and through the notches 1580 in the securing member 1540, thereby preventing the securing member from being removed from the aperture 1530. The friction between the pin and the hole through which it is disposed may be great enough to prevent the pin from falling out. Alternatively, adhesives, sonic welding or any other suitable connection method may be used to secure the pin 1570 in the hole 1571 of the slider base 1560, thereby holding the securing member 1540 in place while still allowing it freedom to rotate, as described below.

Before or after the securing member 1540 is joined to the slider base 1560 via the pin 1570, the pull tab 1504 may be inserted into the cavity of slider base 1560. This may be accomplished, for example, if the slider base or the pull tab has a slight opening through which the other may be placed.

Referring still to FIG. 15, the second slider 1501 may be assembled in a similar manner to slider 1500. Although FIG. 15 shows a second slider 1501 that does not include a releasable security device, one skilled in the art will recognize that both sliders 1500 and 1501 may include releasable security devices. For the zipper shown in FIG. 15, however, only slider base 1500 includes a releasable security device. Slider 1501 in FIG. 15 may include a slider base 1561. Slider base 1561 may be manufactured as one piece by using, for example, a molding technique. The second slider 1501 may also include a pull tab 1510. The slider base may include lock portions 1506 configured to align with the lock portions 1516 of the releasable security device 1512. Slider 1501 may be assembled in a manner similar to the assembly of slider 1500 as described above, and as shown in FIG. 15.

Figure 16:
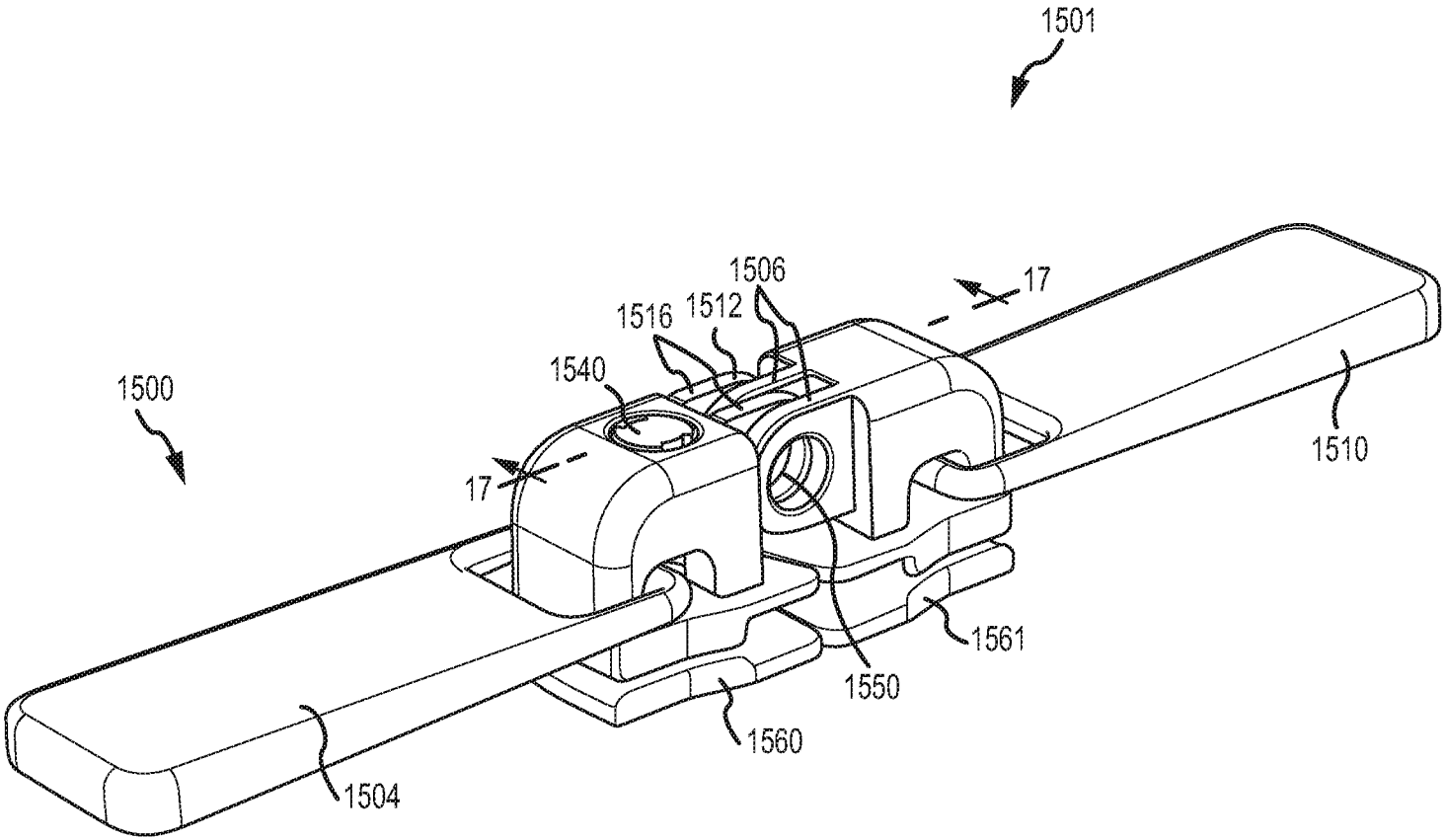
FIG. 16 is a perspective view of the zipper of FIG. 15, showing the two zipper sliders joined so that a security apparatus may be placed therethrough.

With reference to FIG. 16, sliders 1500 and 1501 are shown assembled and positioned such that a security apparatus, such as a lock, may be placed in the aperture 1550 defined by the lock portions 1516 of the releasable security device 1512 and the lock portions 1506 of the slider base 1561.

Figure 17:
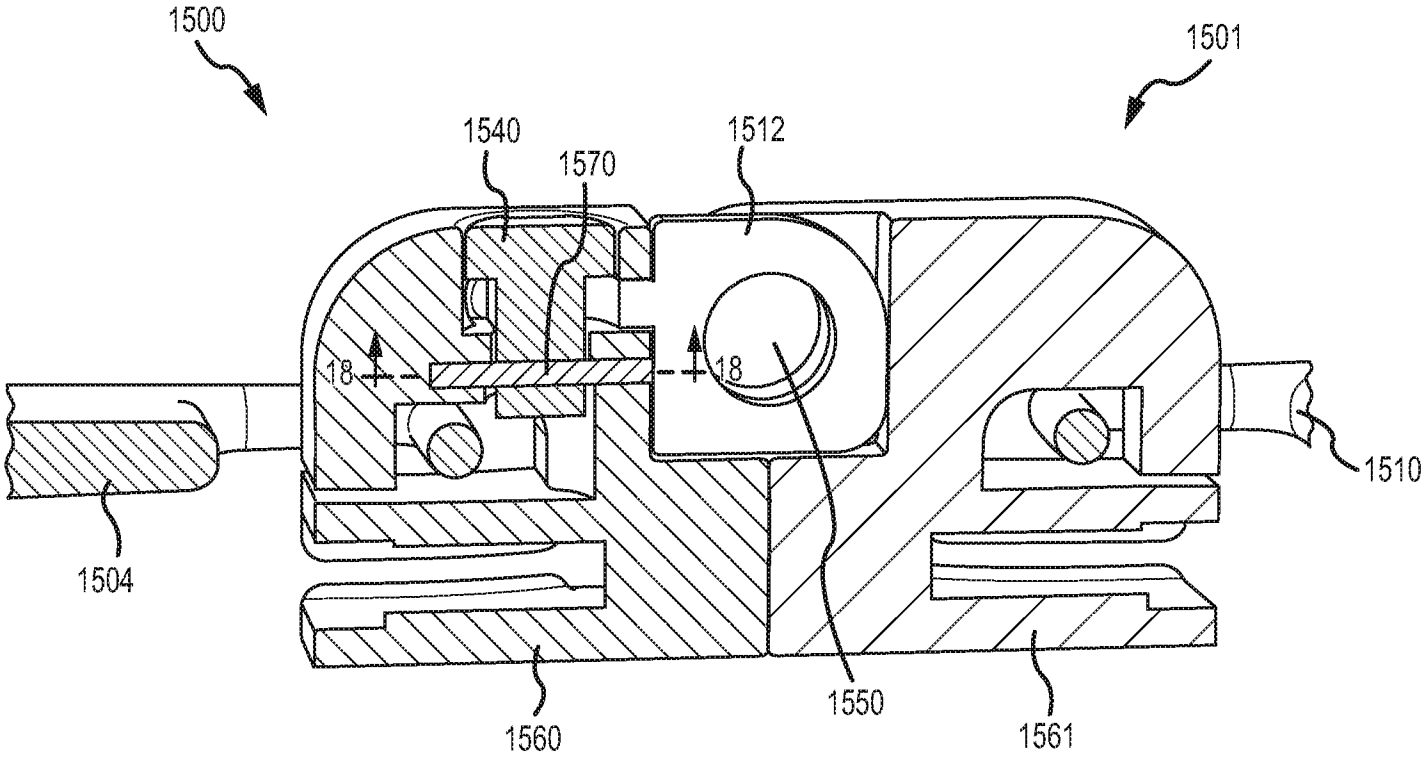
FIG. 17 is a cross-section view of the zipper of FIG. 15, viewed along line 17-17 of FIG. 16.

FIG. 17 shows a cross section view of fully assembled sliders 1500 and 1501 along line 17-17 of FIG. 16. In particular, FIG. 17 shows releasable security device 1512 joined to slider base 1560 via a securing member 1540 and pin 1570. The notches and structure (not visible in FIG. 18) of the securing member 1540 may be configured so that the friction between pin 1570 and the securing member may prevent the securing member from rotating. However, the friction force may be overcome by turning the securing member 1540 (for example with a key that matches the securing member's head), thereby allowing the securing member to rotate within the aperture. When the securing member 1540 is rotated to a predetermined position, the releasable security device 1512 may be removed from the slider base 1560. Similarly, when a user desires to rejoin the releasable security device with the slider, the releasable security device may be inserted into the slot in the slider, and the securing member 1540 may be rotated to another predetermined position, thereby securing releasable security device 1512 to the slider base 1560.

Figure 18A:
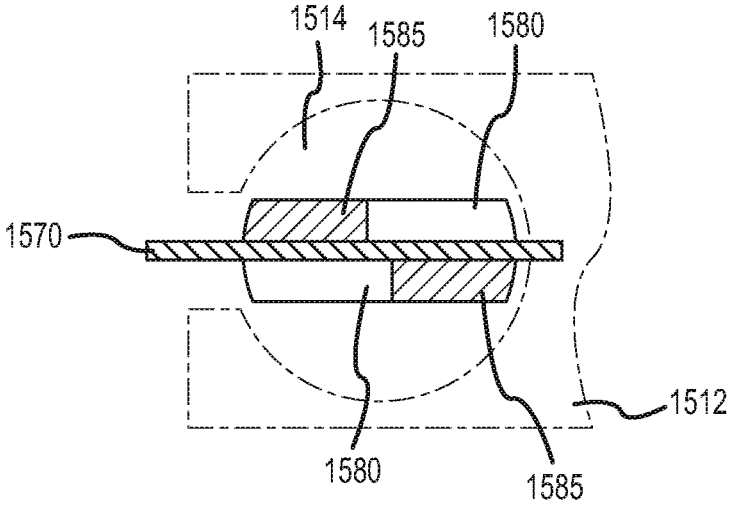
FIGS. 18A and 18B are cross-section views of the securing member, pin, and releasable security device of the zipper of FIG. 15, viewed along line 18-18 of FIG. 17; portions of the sixth zipper slider are omitted and the releasable security device is shown in dotted lines in order to better show the securing member, pin and releasable security device.
Figure 18B:
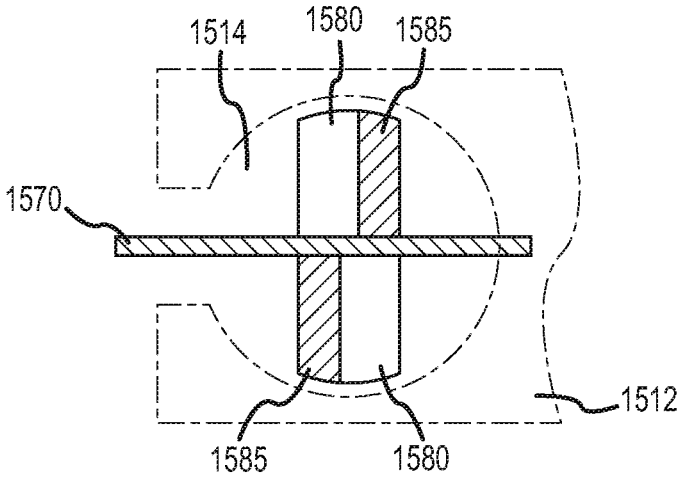

With reference to FIGS. 18A and 18B, the operation of the pin 1570 and the securing member 1540 is described. In order to better show the securing member and the releasable security device, the slider base 1560 is not shown in FIGS. 18A and 18B, and the releasable security device 1512 is shown in dashed lines. Specifically FIGS. 18A and 18B demonstrate how the pin may hold the securing member in place and limit the securing member's rotation to 90 degrees because of the alternating notches 1580 and structure 1585 in the securing member. The cross section of securing member 1540 shown in FIGS. 18A and 18B shows that the securing member may have two notches 1580 at the point in the securing member that aligns with the hole 1571 in the slider base 1560. The cross section also shows, however, that there may be some structure 1585 that engages with the pin. For example, if the securing member 1540 is positioned as in FIG. 18A, the securing member may not be rotated counterclockwise, but may be rotated 90 degrees clockwise to arrive at the position shown in FIG. 18B. Once the securing member is rotated 90 degrees as shown in FIG. 18B, any further attempt to continue rotating the securing member past 90 degrees may be prevented because the pin engages with the structure 1585 of the securing member 1540. Similarly, if the securing member starts positioned as in FIG. 18B, the securing member may not be rotated clockwise, but may be rotated 90 degrees counterclockwise to arrive at the position shown in FIG. 18A.

FIGS. 18A and 18B also demonstrate the coupling and decoupling of the releasable security device 1512 with the slider base 1560. FIG. 18A shows the securing member 1540 in an 'unlocked' position. With the securing member in an unlocked position, releasable security device 1512 may be removed from slider base 1560 because the securing member does not engage the edges of the engagement hole 1514. FIG. 18B shows the securing member in a 'locked' position. With the securing member in a locked position, releasable security device 1512 may not be removed from slider base 1560 because the securing member 1540 does engage the edges of the engagement hole 1514. Note that the releasable security device 1512 is shown in dotted lines in FIGS. 18A and 18B because, as FIG. 17 makes clear, the edges of the engagement hole that engage the securing member do so along a different length of the securing member than the portion where the pin is disposed through the securing member. Note also that the slider base has been omitted from the cross section views in FIGS. 18A and 18B for clarity.

Figure 19:
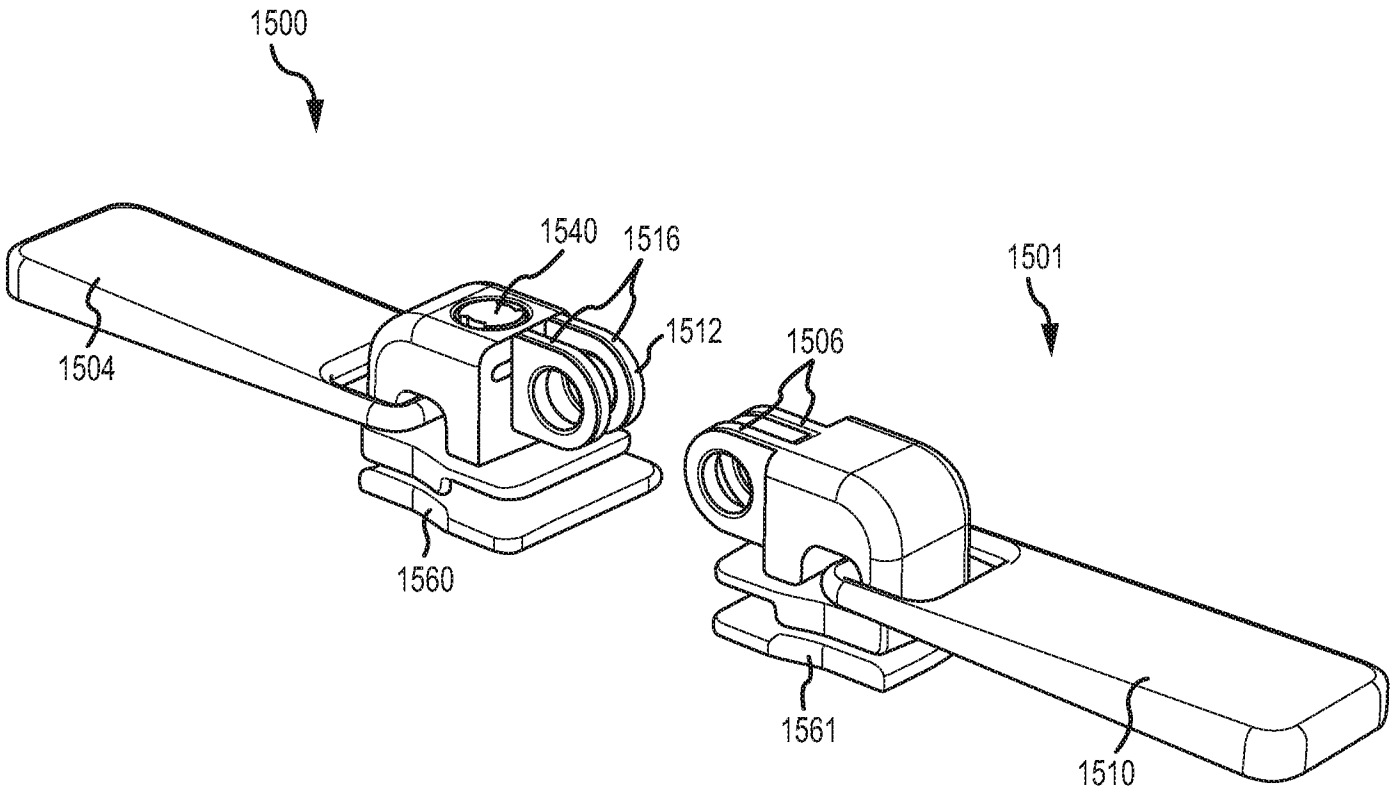
FIG. 19 is a perspective view of the zipper of FIG. 15, showing the two sliders separated from each other.

FIG. 19 shows sliders 1500 and 1501 separated. As can be seen in FIG. 19, because the pin 1570 is inserted into slider 1500 on the same face of the slider base 1560 as the releasable security device 1512 is inserted, the pin is inaccessible when the releasable security device is in place and/or when slider 1500 is connected to slider 1501 via a locking apparatus placed through the lock portions 1506, 1516. This may enhance the security of the zipper because the pin cannot be easily removed when the releasable security device 1512 is in place.

Figure 20A:
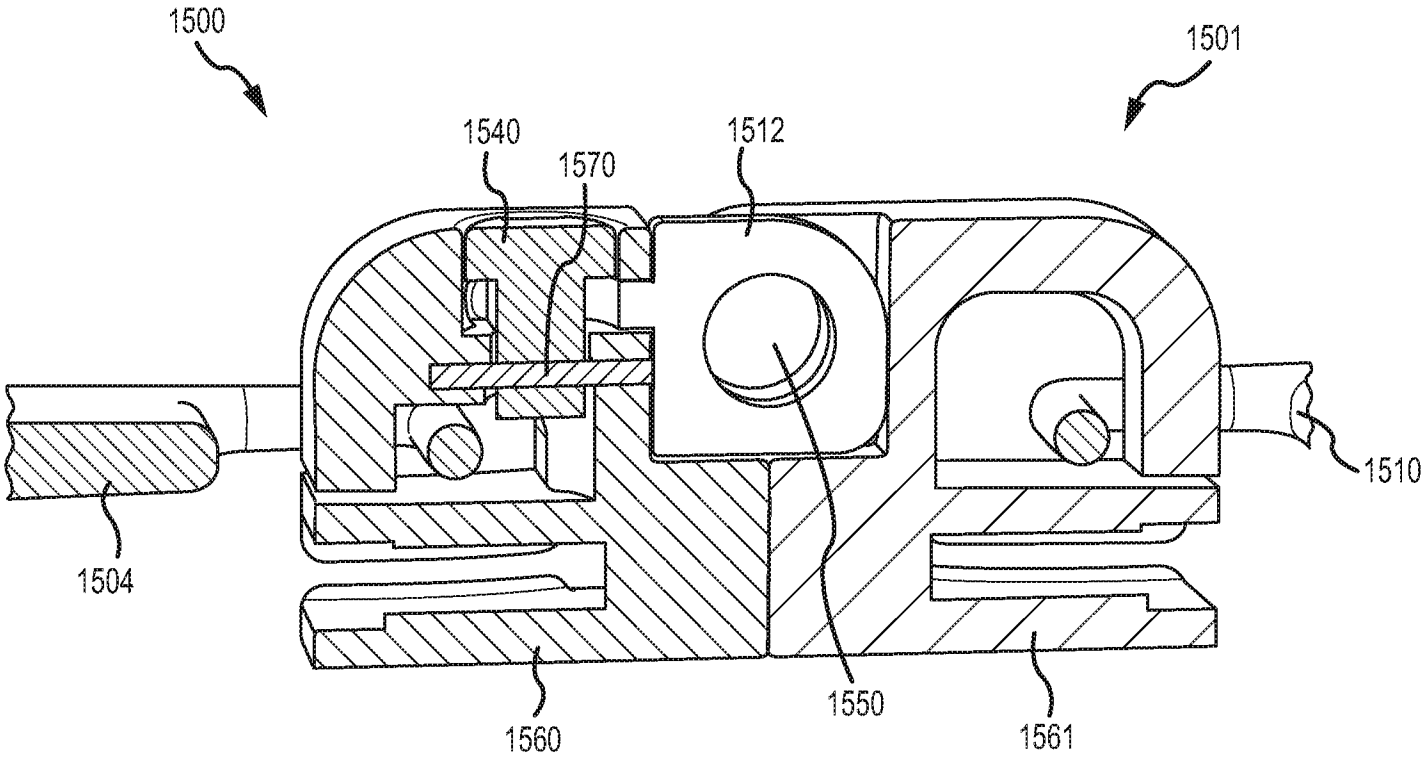
FIGS. 20A and 20B are cross section views of a seventh and eighth zipper with a slider base of reduced thickness.
Figure 20B:
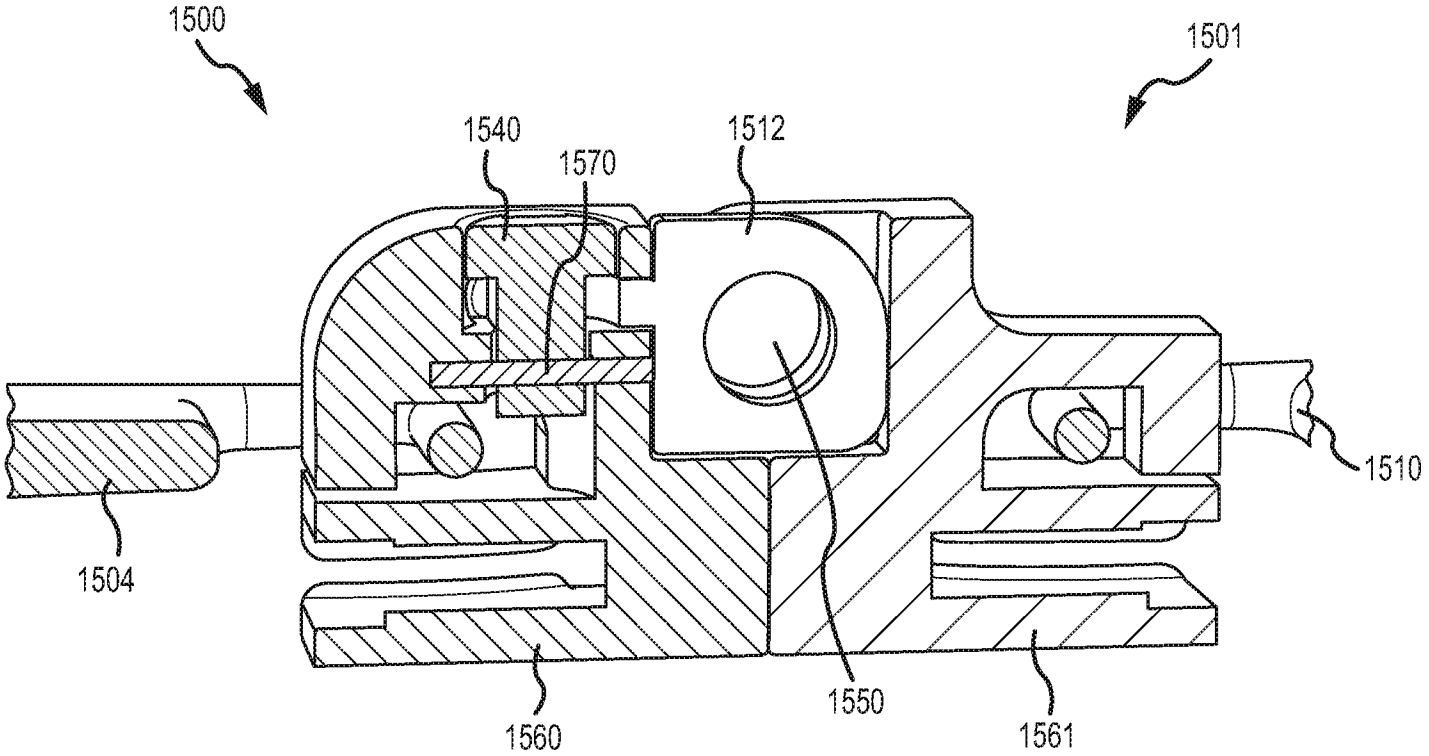

FIGS. 20A and 20B show two different manufacturing options for slider base 1561 of slider 1501. Specifically, FIG. 20A shows a slider base with a more hollowed out region where pull tab 1510 is joined to slider 1501, as compared with slider base 1561 of FIG. 17 for example. FIG. 20B shows a slider base 1561 that is also similar to slider base 1561 of FIG. 17, except that slider base 1561 in FIG. 20B has a reduced thickness because a portion on the top of the slider base has been eliminated. Although FIGS. 20A and 20B show reductions made to only one region of the slider base 1561, the thickness of other portions of both sliders 1500, 1501 may similarly be reduced. The thickness may be reduced in some, but not all embodiments, in order to ensure a strong enough mold for the zipper.

Mechanisms, appropriately modified, as shown in relation to FIGS. 2A through 20B are but some examples of possible ways that a releasable security device may be detachable from a slider base. In general, a releasable security device may be attached and detached from corresponding zipper sliders in any manner known or hereafter developed. Also, the manufacturing and assemblage teachings of FIGS. 11 through 20B and accompanying text may be applied to various embodiments, including any of the embodiments described herein with only minor modifications. The manufacturing and assemblage teachings of FIGS. 11 through 20B and accompanying text may also be applied to other embodiments of zippers. As just one example, a pin, similar to the pin 1570 in FIGS. 15-19, may be used to secure a securing member in the modular zipper embodiment shown in FIGS. 11-14.

The foregoing merely illustrates the principles of the disclosed embodiments. Various modifications and alterations to the described embodiments will be apparent to those skilled in the art in view of the teachings herein. It will thus be appreciated that those skilled in the art will be able to devise numerous systems, arrangements and methods which, although not explicitly shown or described herein, embody the principles of the disclosure and are thus within the spirit and scope of the present disclosure.

A variety of embodiments and variations of structures and methods are disclosed herein. Where appropriate, common reference numbers and words were used for common structural and method features. However, unique reference numbers and words were sometimes used for similar or the same structural or method elements for descriptive purposes. As such, the use of common or different reference numbers or words for similar or the same structural or method elements is not intended to imply a similarity or difference beyond that described herein.

All directional references (e.g., upper, lower, upward, downward, left, right, leftward, rightward, top, bottom, above, below, vertical, horizontal, clockwise, and counterclockwise) are only used for identification purposes to aid the reader's understanding of the embodiments of the present disclosure, and do not create limitations, particularly as to the position, orientation, or use of the embodiments unless specifically set forth in the claims. Connection references (e.g., attached, coupled, connected, joined, and the like) are to be construed broadly and may include intermediate members between a connection of elements and relative movement between elements. As such, connection references do not necessarily infer that two elements are directly connected and in fixed relation to each other.

In some instances, components are described with reference to "ends" having a particular characteristic and/or being connected with another part. However, those skilled in the art will recognize that the present disclosure is not limited to components which terminate immediately beyond their points of connection with other parts. Thus, the term "end" should be interpreted broadly, in a manner that includes areas adjacent, rearward, forward of, or otherwise near the terminus of a particular element, link, component, part, member or the like. In methodologies directly or indirectly set forth herein, various steps and operations are described in one possible order of operation, but those skilled in the art will recognize that steps and operations may be rearranged, replaced, or eliminated without necessarily departing from the spirit and scope of the present disclosure. It is intended that all matter contained in the above description or shown in the accompanying drawings shall be interpreted as illustrative only and not limiting. Changes in detail or structure may be made without departing from the spirit of the disclosure.

What is claimed is:

1. A zipper system for a luggage piece comprising:
a zipper track;
a zipper including a slider operatively associated with the zipper track; and
the slider comprising:
a slider base;
a securing member movably joined to the slider base;
a security device releasably joined to the slider base by the securing member, the security device including at least one aperture to receive at least a portion of a lock;
the securing member adapted to be moved relative to the slider base by a key in order to secure the security device to the slider base and to release the security device from the slider base; and
at least a portion of the security device is received within a slot of the slider base when secured to the slider base; and
the zipper includes a pull tab joined to either the security device or the slider base.

2. The zipper system of claim 1, wherein the securing member includes a keyhole adapted to receive the key.

3. The zipper system of claim 1, wherein the securing member comprises a first structure, and the key comprises a second structure that is complementary to the first structure.

4. The zipper system of claim 3, wherein the first structure comprises indentations, and the second structure comprises prongs of the key.

5. The zipper system of claim 1, further comprising a pin that secures the securing member to the slider base.

6. The zipper system of claim 5, wherein the pin is welded, adhered, or friction fit to the slider base.

7. The zipper system of claim 5, wherein the pin is inaccessible when the security device is joined to the slider.

8. The zipper system of claim 5, wherein the securing member includes notches, and the pin and the securing member are configured to allow the securing member to rotate approximately 90 degrees to selectively secure and release the security device to and from the slider base.

9. The zipper system of claim 1, wherein the security device includes an engagement portion, and the securing member comprises an elongated plate rotatably joined to the slider base for selective engagement with the engagement portion of the security device.

10. The zipper system of claim 1, wherein the securing member comprises a fastener, and the security device includes an aperture adapted to receive the fastener.

11. The zipper system of claim 1, wherein the security device includes a lock portion that includes the at least one aperture and an engagement portion with an engagement hole where the engagement portion is oriented transverse to the lock portion, and the slider base includes a slot that receives therein said engagement portion is received in the slot.

12. The zipper system of claim 1, wherein the slider base comprises a modular base and a modular upper portion, and the security device is releasably joined to the modular upper portion.

13. The zipper system of claim 1, wherein the slider is joined to a second slider via the security device secured to the slider and a lock positioned within the at least one aperture of the security device and an aperture of the second slider, and the slider is not joined to the second slider when the security device is released from the slider while the security device remains joined to the second slider via the lock.

14. A zipper system for a luggage piece comprising:
a zipper track;
a zipper including a slider operatively associated with the zipper track; and
the slider comprising:
a slider base;
a securing member movably joined to the slider base;
a security device releasably joined to the slider base by the securing member, the security device including at least one aperture to receive at least a portion of a lock and an engagement hole adapted to receive the securing member therethrough; and
the securing member adapted to be moved relative to the slider base by a key in order to secure the security device to the slider base and to release the security device from the slider base; and
the zipper includes a pull tab joined to either the security device or the slider base.

15. The zipper system of claim 14, wherein the securing member includes a keyhole adapted to receive the key.

16. The zipper system of claim 14, wherein the securing member comprises a first structure, and the key comprises a second structure that is complementary to the first structure.

17. The zipper system of claim 16, wherein the first structure comprises indentations, and the second structure comprises prongs of the key.

18. The zipper system of claim 14, further comprising a pin that secures the securing member to the slider base.

19. The zipper system of claim 18, wherein the pin is welded, adhered, or friction fit to the slider base.

20. The zipper system of claim 18, wherein the pin is inaccessible when the security device is joined to the slider.

21. The zipper system of claim 18, wherein the securing member includes notches, and the pin and the securing member are configured to allow the securing member to rotate approximately 90 degrees to selectively secure and release the security device to and from the slider base.

22. The zipper system of claim 14, wherein the security device includes an engagement portion, and the securing member comprises an elongated plate rotatably joined to the slider base for selective engagement with the engagement portion of the security device.

23. The zipper system of claim 14, wherein the securing member comprises a fastener, and the engagement hole is adapted to receive the fastener.

24. The zipper system of claim 14, wherein the security device includes a lock portion that includes the at least one aperture and an engagement portion that includes the engagement hole where the engagement portion is oriented transverse to the lock portion, and the slider base includes a slot that receives therein said engagement portion.

25. The zipper system of claim 14, wherein at least a portion of the security device is received within a slot of the slider base when secured to the slider base.

26. The zipper system of claim 14, wherein the slider base comprises a modular base and a modular upper portion, and the security device is releasably joined to the modular upper portion.

27. The zipper system of claim 14, wherein the slider is joined to a second slider via the security device secured to the slider and a lock positioned within the at least one aperture of the security device and an aperture of the second slider, and the slider is not joined to the second slider when the security device is released from the slider while the security device remains joined to the second slider via the lock.

* * * * *